US007524192B2

(12) United States Patent
Cummings et al.

(10) Patent No.: US 7,524,192 B2
(45) Date of Patent: Apr. 28, 2009

(54) TRAILER TOW CONNECTOR ASSEMBLY INCLUDING FIRST AND SECOND CONNECTOR PORTIONS HAVING ASSOCIATED COVERS

(75) Inventors: Dave Cummings, South Weymouth, MA (US); Michael O'Reilly, Holliston, MA (US); Neal Pugh, Taunton, MA (US); Mark Vincent, Cumberland, RI (US)

(73) Assignee: Stoneridge Control Devices, Inc., Canton, MA (US)

( * ) Notice: Subject to any disclaimer, the term of this patent is extended or adjusted under 35 U.S.C. 154(b) by 0 days.

(21) Appl. No.: 11/773,008

(22) Filed: Jul. 3, 2007

(65) Prior Publication Data

US 2008/0032515 A1 Feb. 7, 2008

Related U.S. Application Data

(60) Division of application No. 11/101,379, filed on Apr. 6, 2005, now Pat. No. 7,331,792, which is a continuation-in-part of application No. 10/666,955, filed on Sep. 18, 2003, now abandoned.

(60) Provisional application No. 60/411,709, filed on Sep. 18, 2002.

(51) Int. Cl.
*H01R 33/00* (2006.01)

(52) U.S. Cl. ..... 439/35; 439/137; 220/242

(58) Field of Classification Search ..... 439/34, 439/137, 142; 220/242
See application file for complete search history.

(56) References Cited

U.S. PATENT DOCUMENTS

| | | | | |
|---|---|---|---|---|
| 2,728,894 | A * | 12/1955 | Peters | 439/142 |
| 4,058,358 | A * | 11/1977 | Carlisle | 439/142 |
| 4,134,516 | A * | 1/1979 | Sullo | 220/242 |
| 6,447,302 | B1 * | 9/2002 | Davis | 439/34 |
| 7,264,489 | B2 * | 9/2007 | Higham et al. | 439/137 |

* cited by examiner

*Primary Examiner*—Truc T Nguyen
(74) *Attorney, Agent, or Firm*—Grossman, Tucker, Perreault & Pfleger, PLLC

(57) ABSTRACT

An electrical connector including a first connector portion and a second connector portion. First and second covers are pivotally attached to the body about a common axis for covering the first and second connector portion.

14 Claims, 42 Drawing Sheets

SECTION A-A

TRAILER TOW CONNECTOR ASSEMBLY INCLUDING FIRST AND SECOND CONNECTOR PORTIONS HAVING ASSOCIATED COVERS

CROSS-REFERENCE TO RELATED APPLICATIONS

This application is a divisional of U.S. patent application Ser. No. 11/101,379, filed Apr. 6, 2005, which is a continuation-in-part of U.S. patent application Ser. No. 10/666,955, filed on Sep. 18, 2003, which claims the benefit of U.S. provisional patent application Ser. No. 60/411,709, filed on Sep. 18, 2002 the entire disclosure of which applications are incorporated herein by reference.

TECHNICAL FIELD

The present invention relates generally to electrical connectors, and, in particular, to electrical connectors for making electrical connections between a vehicle and an apparatus towed by the vehicle.

BACKGROUND

It is commonplace to provide an electrical connector on a vehicle for accepting a corresponding connector that is cable-connected to electrical components of a towed apparatus, e.g. a trailer, boat, etc. Because of the multiplicity of components in vehicles for such things as running lights, brake lights, and signal lights, as well as electric brakes and other auxiliary equipment, the vehicle connector may provide seven or more contact terminals, e.g. arrayed in a circular pattern about a central terminal. The towed apparatus, however, may not require connection to each contact terminal, and thus may include a connector having fewer contact terminals than the vehicle connector.

In such cases, adaptors have been developed for making appropriate electrical connections from a vehicle to a towed apparatus. For example, 7-way (on vehicle) to 4-way (on towed apparatus) adaptors are well known. Alternatively, vehicles have been provided with multiple connector types to eliminate the need for an adaptor. In one example, a vehicle may be provided with both 7-way and 4-way connectors, each having their own wiring harness and connections to the vehicle electrical system.

Cost and water corrosion have, however, been persistent problems with known vehicle connector types. Four-way, connectors, for example, are typically encapsulated with soft rubber and include a molded, flexible cover to protect the connector when no plug is inserted in the socket. These four-way connectors are susceptible to water intrusion through the cover, as well as through the exit location of the wires at the rear of the connector. This water intrusion typically causes corrosion of the four-way contacts. In addition, in the case where multiple vehicle connectors are provided to avoid the use of an adaptor the separate wire harnesses for the connectors and the separate connector components are costly.

There is, therefore, a need for a connector configuration that may be cost-effectively produced and is resistant to corrosion caused by water intrusion. There is also a need in the art of a combined connector configuration that may be cost-effectively produced and is resistant to corrosion caused by water intrusion.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

Figure 1:
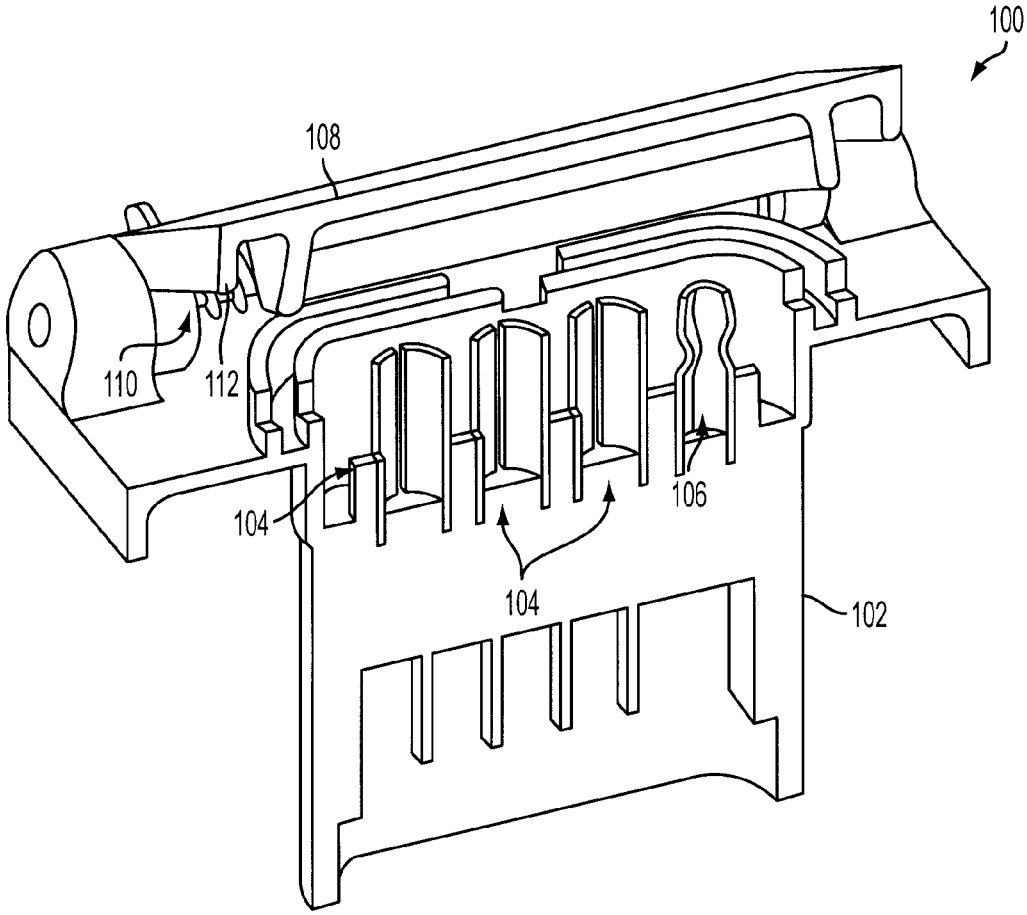
FIG. 1 illustrates an exemplary four-way connector consistent with the invention in a cross-sectional view.
Figure 2:
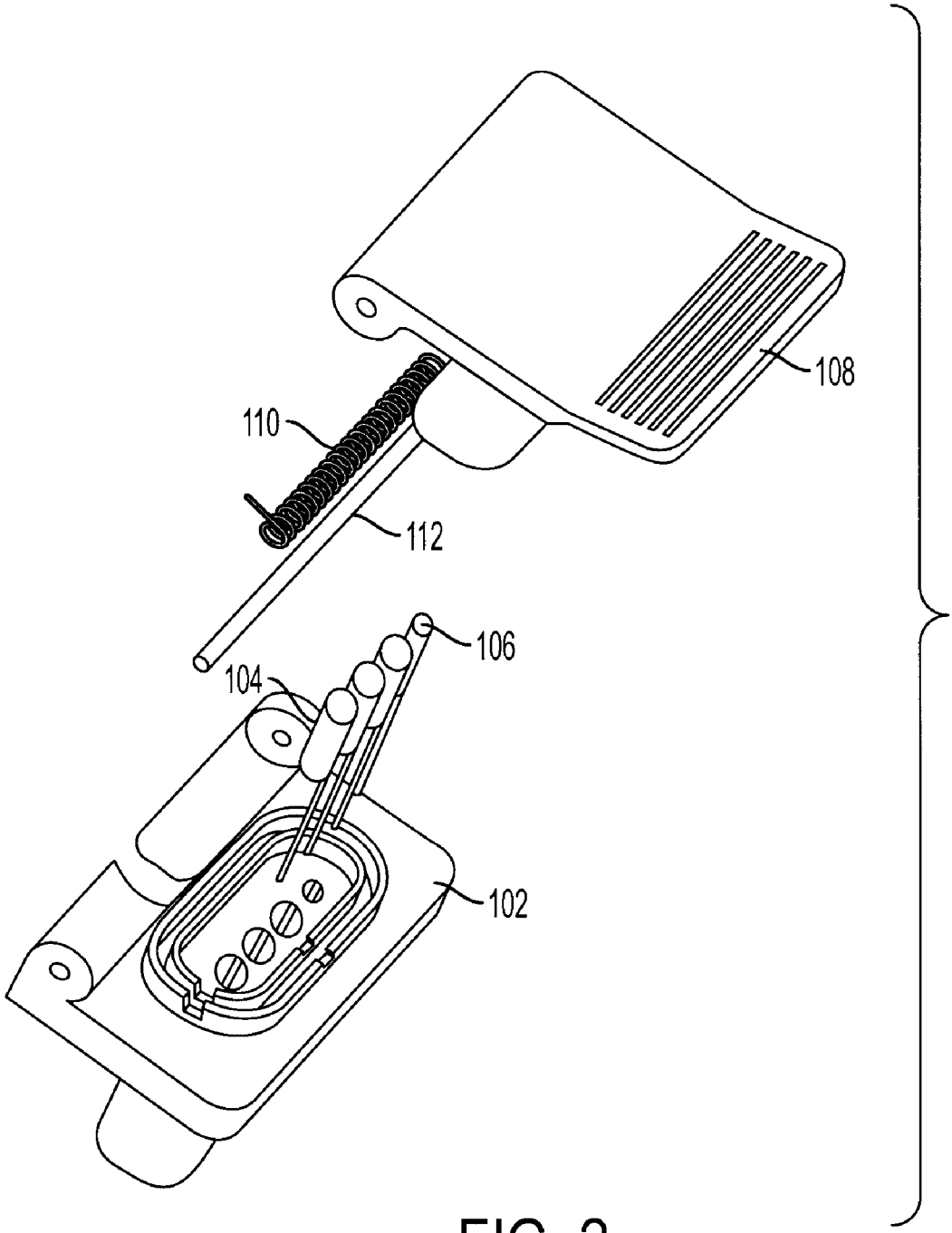
FIG. 2 is an exploded diagram of the exemplary connector shown in FIG. 1.

The present invention relates generally to electrical connector assemblies. According to a first aspect, the electrical connector includes a body portion and a cover portion biased to a closed position. This aspect of the present invention is described with reference to a four-way connector as may be used for making electrical connections between a vehicle and an apparatus towed by the vehicle. Those skilled in the art, however, will recognize that the present invention may be utilized for a host of other application. Thus, it is to be understood that the present invention is not limited to the illustrated exemplary embodiments described herein. Rather, the present invention may be incorporated in a wide variety of devices without departing from the spirit and scope of the present invention.

Turning to FIGS. 1 through 10, an exemplary connector 100 consistent with the present invention is shown. The connector generally includes a body portion 102 and a cover 108. The body portion 102 contains four electrical contacts, including three female barrel contacts 104, and a plug type contact 106. The body portion 102 may, of course, contain more or fewer contacts that may be of varying styles known to those having skill in the art.

Figure 3:
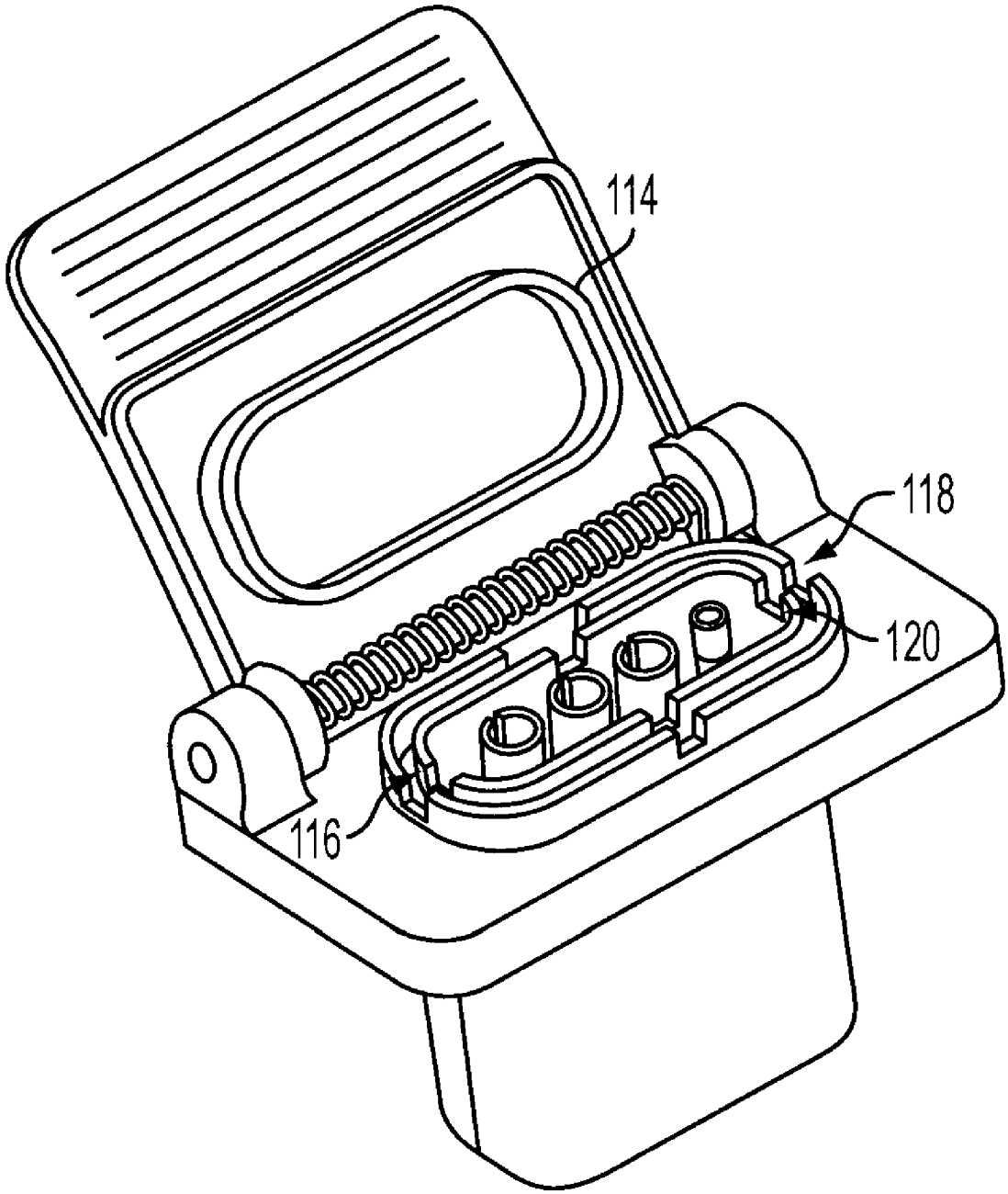
FIG. 3 is a perspective view of the exemplary four-way connector of FIG. 1.
Figure 4:
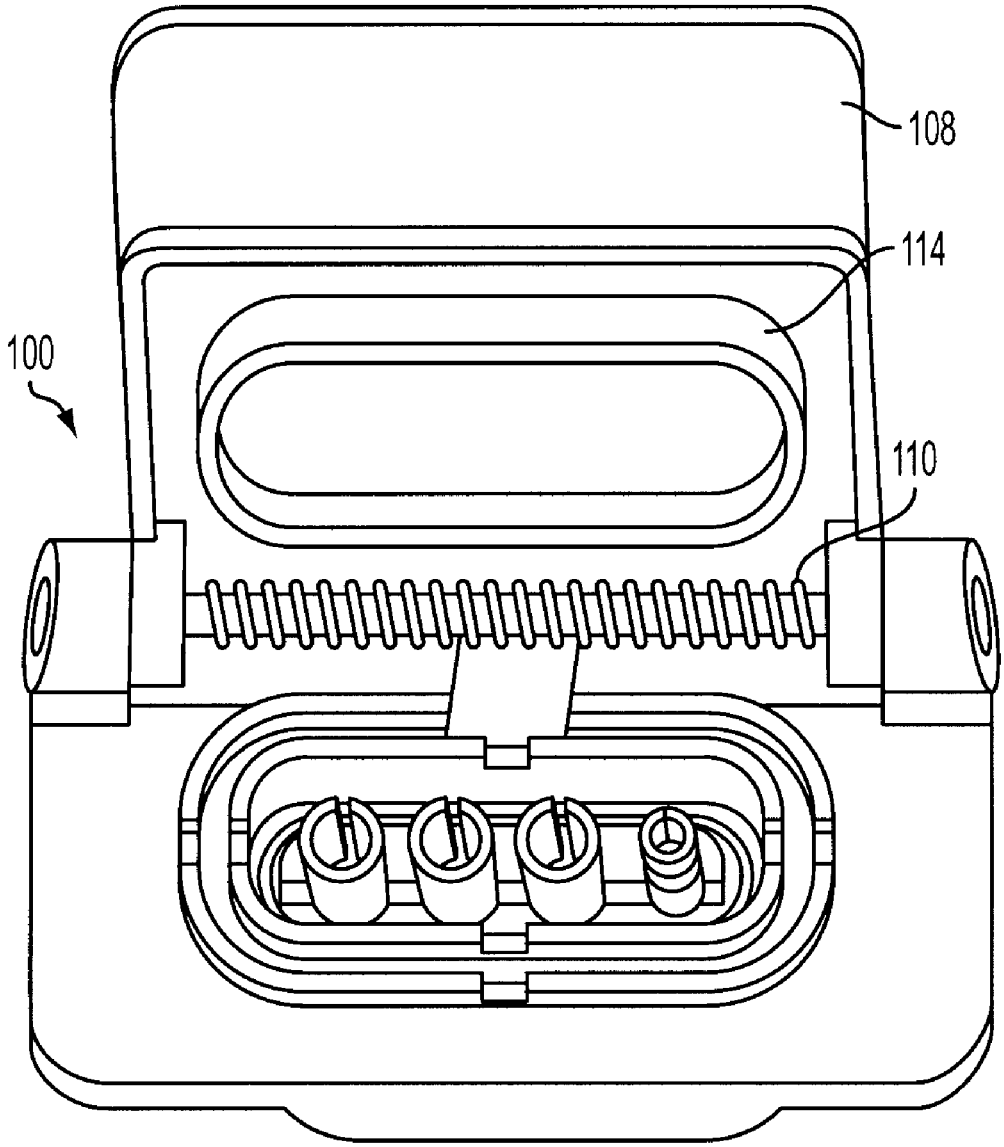
FIG. 4 is a top perspective view of the exemplary four-way connector shown in FIG. 1.
Figure 5:
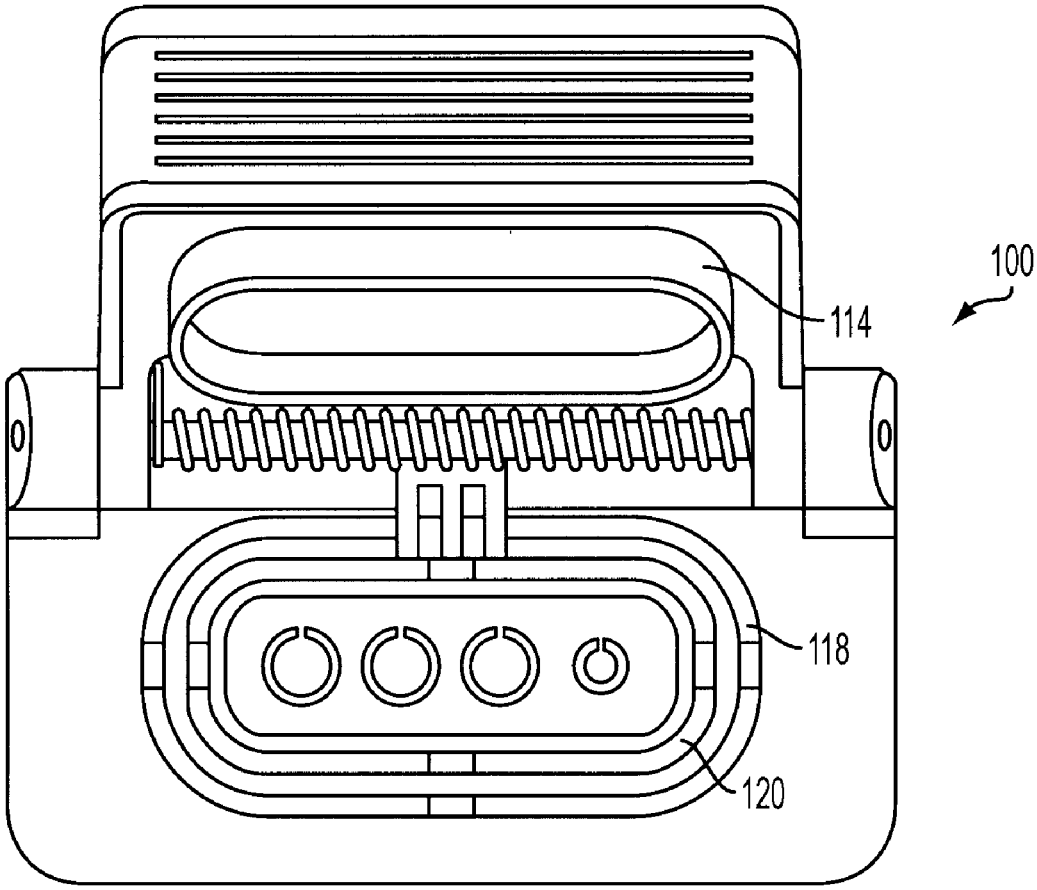
FIG. 5 shows the exemplary four-way connector of FIG. 1 in a top elevation view.
Figure 6:
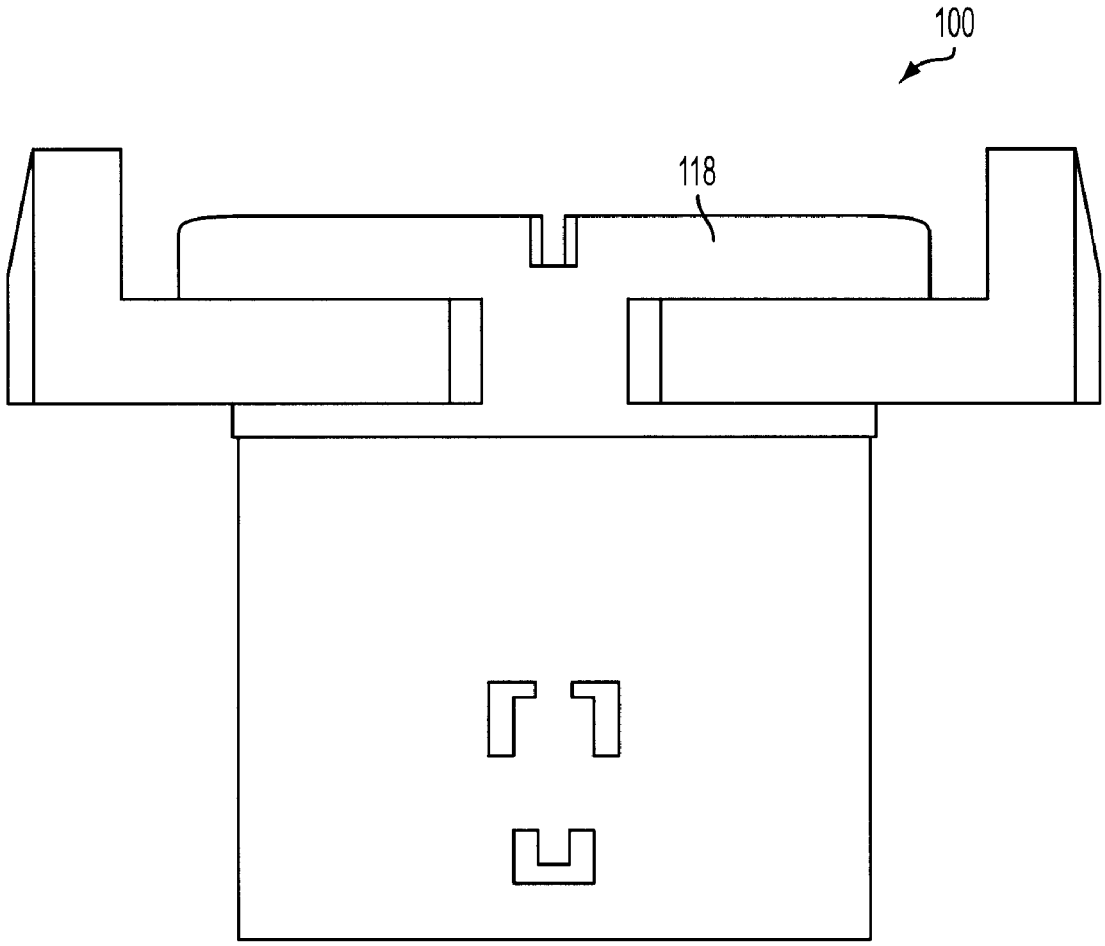
FIG. 6 is a rear elevation of an exemplary four-way connector consistent with the present invention.
Figure 7:
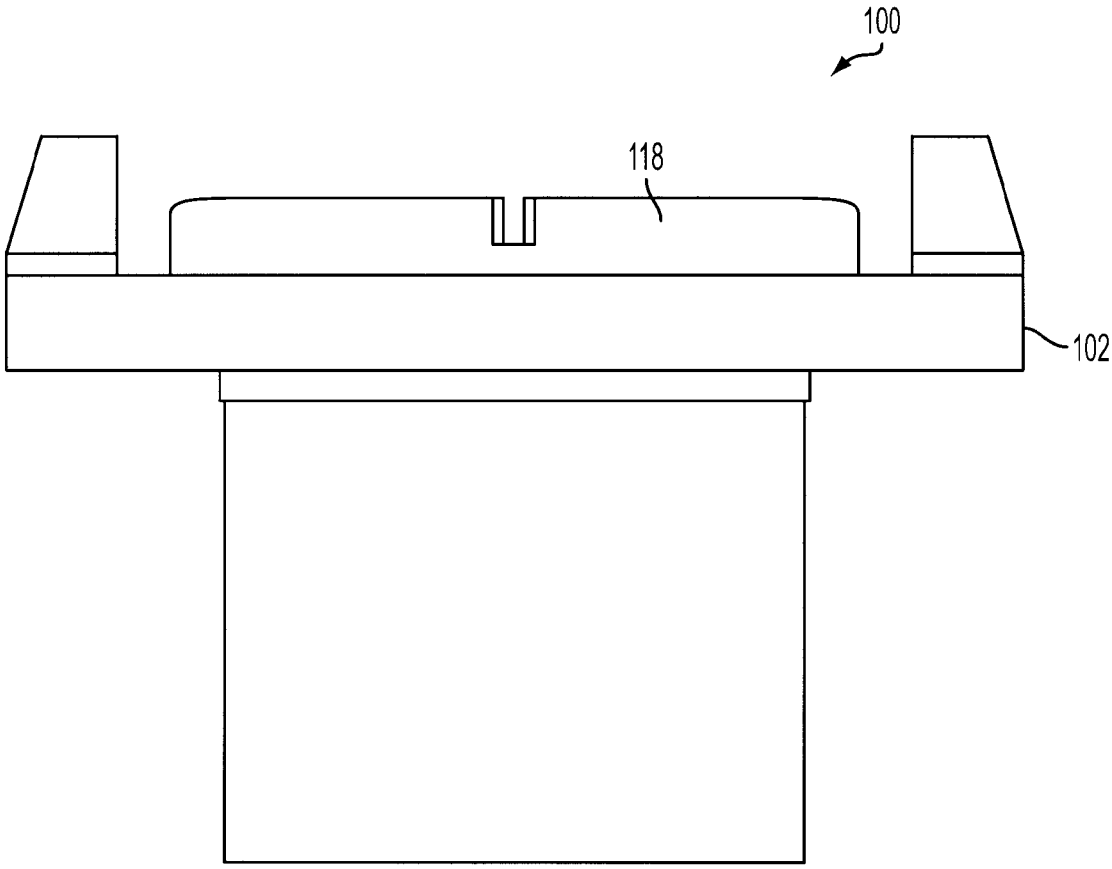
FIG. 7 shows a front elevation of an exemplary four-way connector consistent with the present invention.
Figure 8:
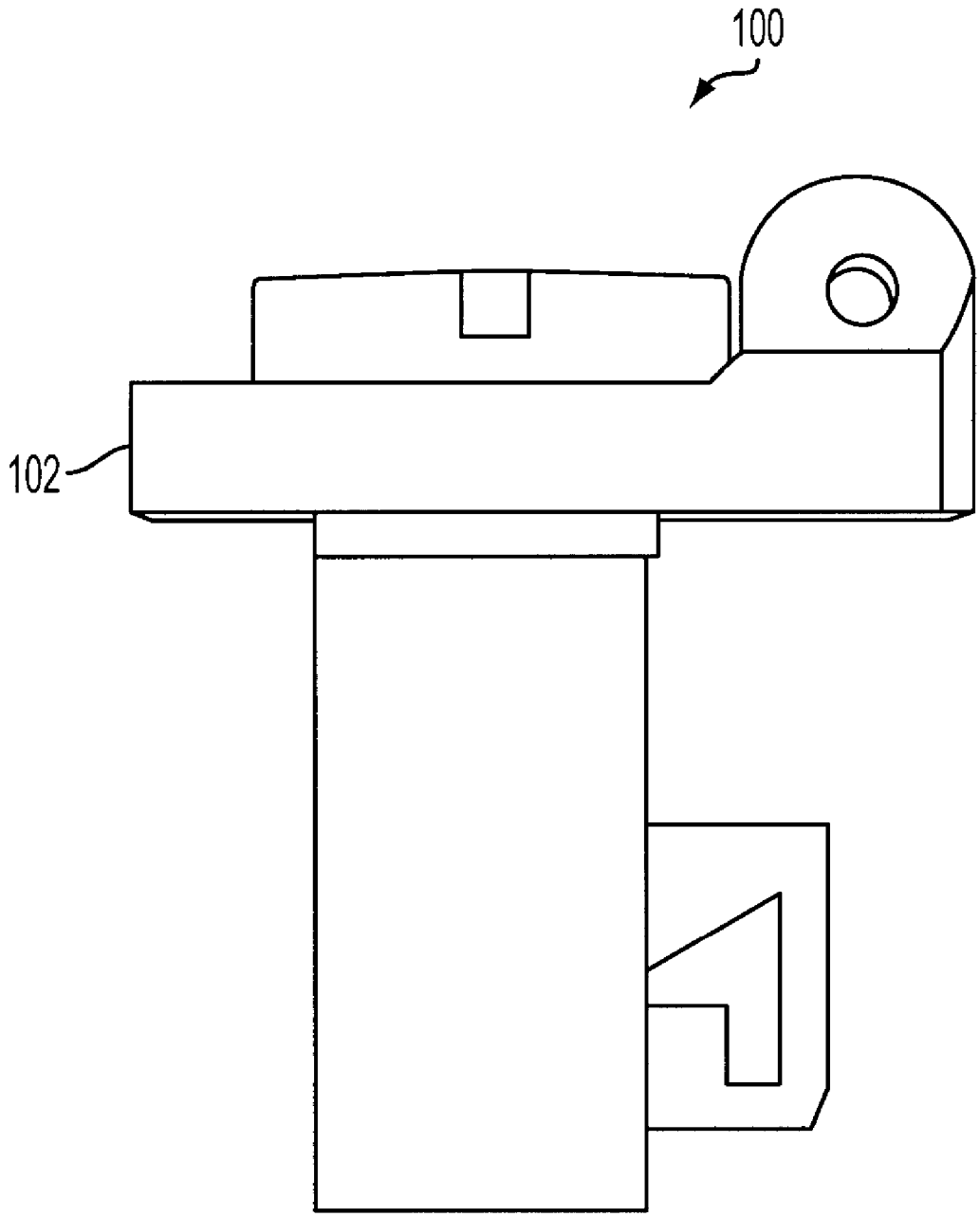
FIG. 8 shows a side elevation of an exemplary four-way connector consistent with the present invention.
Figure 9:
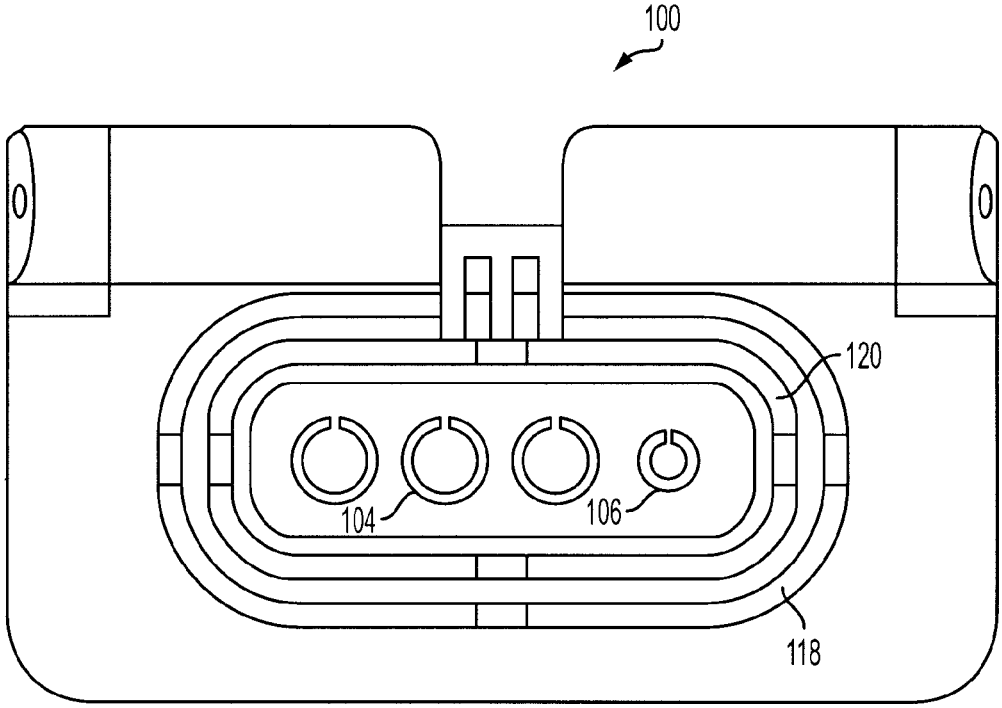
FIG. 9 is a top elevation of an exemplary four-way connector consistent with the present invention with the cover not attached.

In the illustrated embodiment, as best seen in FIGS. 3 and 4, the cover 108 may be pivotally connected to the body portion 102 about the long edge of the connector body 102. According to the exemplary embodiment, pivotal connection may be accomplished via a pin 112 passing through corresponding devises on the cover 108 and body portion 102. The cover 108 is biased toward a closed configuration. In the illustrated embodiment, a cover spring 110 may be provided over the pin 112 to bias the cover 108 toward a closed configuration. In the exemplary embodiment, the cover spring 110 is a torsion spring disposed over the pin 112. Those having skill in the art will appreciate that numerous other spring configurations or biasing mechanisms may suitably be used to bias the cover 108 toward a closed configuration.

As shown, for example in FIG. 3, the inside of the cover 108, i.e., the side facing the connector body portion 102, may include a sealing wall 114 extending therefrom. The body portion 102 may include a corresponding groove 116 formed by opposed walls 118, 120 extending from the body portion 102. When the cover 108 is in a closed configuration the sealing wall 114 may be received in the groove 116 to seal the housing from entry of water and other contaminants.

The spring-loaded cover 108 provides an advantage over conventional rubber caps that tend to inadvertently disengage in that the spring loaded cover 108 resists opening an exposing the connector 100 to water and contaminants. The above-described connector 100 may further be improved by using an elastomeric or foam seal on at least one mating interface between the cover 108 and the connector body portion 102. For example, an O-ring may be provided in the groove 116, such that when the cover 108 is in the closed configuration, the sealing wall 114 is urged against the O-ring. Similarly, a seal may be provided on the portion of the cover defined by the sealing wall. Accordingly, when the cover 108 is in the closed configuration, the inside wall 120 may be urged against the seal.

The connector may also include an integral sealed connector on the back end so water intrusion around the wires is minimized or eliminated. The back end of the sealed connector may include an elastomeric block that is fitted around wires entering the connector, wherein the elastomeric block is compressed by an opening in the back end, thereby forming a tight seal. Additional and alternative sealing configurations on the back end will be apparent to those having skill in the art.

While not illustrated, it should be understood that alternatively, the body portion may include a single upstanding sealing wall and the cover may include a pair or spaced apart walls defining a groove for receiving the sealing wall therebetween. Consistent with yet another variation, the groove may be formed as an indentation in the body portion or cover, as opposed to being defined by a pair of spaced, upstanding walls.

Figure 10:
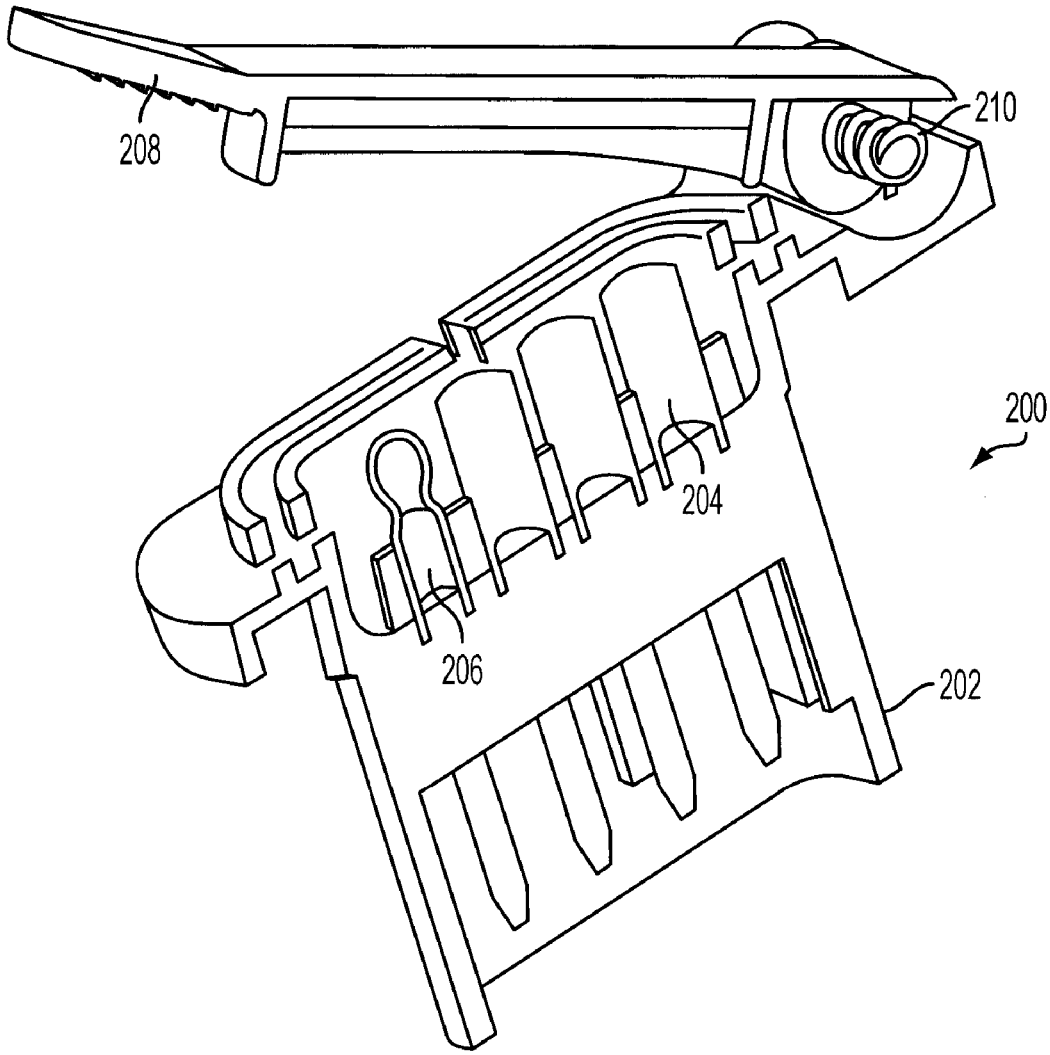
FIG. 10 shows a second exemplary configuration of a four-way connector consistent with the present invention in cross-sectional view.
Figure 11A:
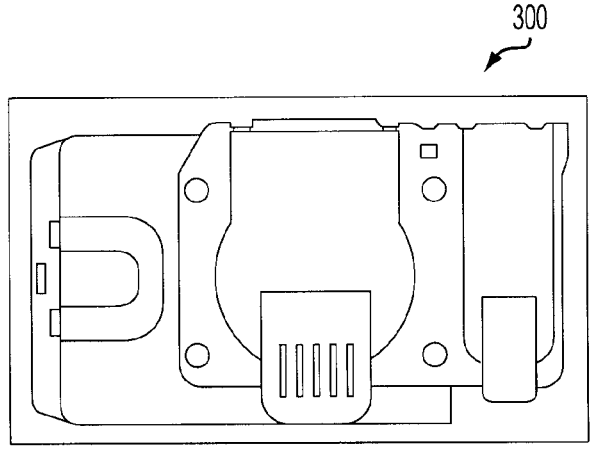
FIGS. 11*a* through 11*c* illustrate an exemplary combination connector consistent with the present invention, and an exemplary terminal/contact assembly consistent with the present invention.
Figure 11B:
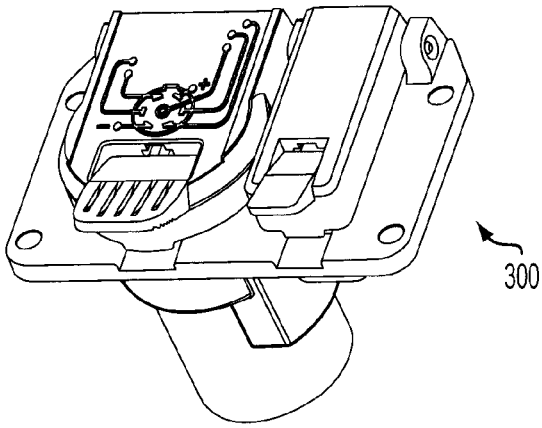
Figure 11C:
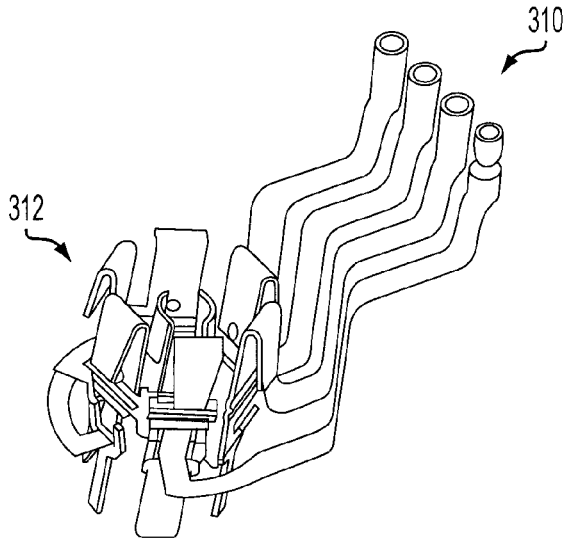

Turning to FIG. 10, a second exemplary connector 200 is shown in a cross-sectional view. Similar to the first exemplary embodiment, the connector 200 includes a body portion 202 including a plurality of contacts 204, 206. The connector 200 also includes a cover 208 that is pivotally coupled to the body portion 202. The cover 208 is biased toward a closed position, e.g., by spring 210. Additionally, the cover 208 may include a sealing wall 214 the may be received in a groove 216 formed by opposed walls 218 and 220 extending from the body portion 202. However, in the case of the second exemplary connector 200, the cover 208 is pivotally connected to the body portion 202 about a short side of the body portion.

Those having skill in the art will appreciate that a connector consistent with the first aspect of the invention is susceptible to numerous alterations and modifications, including, but not limited to, the shape of the connector body and the shape of the cover. Furthermore, various alternative and additional means for pivotally connecting the cover to the body portion will also be understood by those having skill in the art, as will various additional and alternative means for biasing the cover toward a closed configuration.

According to another aspect, the present invention is directed at a combination connector, shown in various views in FIGS. 11 through 19. The combination connector combines two or more electrical connectors having different configurations and/or number of electrical contacts using a common wiring harness. In the exemplary context of an electrical connector between a vehicle and an apparatus towed by the vehicle, a connector consistent with the present invention may provide either a conventional seven-way electrical connector or a conventional four-way electrical connector via a single vehicle wiring harness. Those skilled in the art, however, will recognize that the present invention may be utilized for a host of other application. Thus, it is to be understood that the present invention is not limited to the illustrated exemplary embodiments described herein. Rather, the present invention may be incorporated in a wide variety of devices without departing from the spirit and scope of the present invention.

Figure 12:
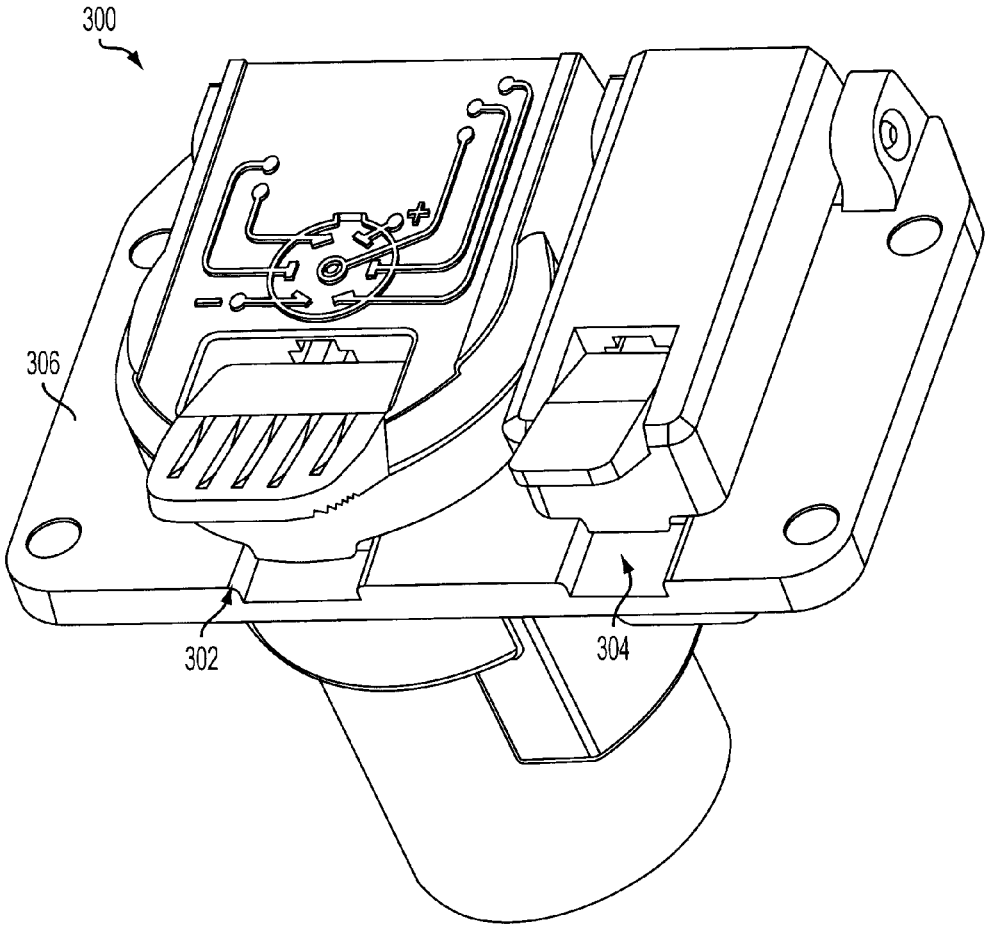
FIG. 12 is a perspective view of an exemplary combination connector consistent with the present invention.

Referring to FIG. 12, an exemplary electrical connector 300 consistent with the present invention is shown. The illustrated exemplary connector 300 generally includes a seven-way connector interface portion 302 and a four-way connector interface portion 304 on the same housing 306.

Figure 16:
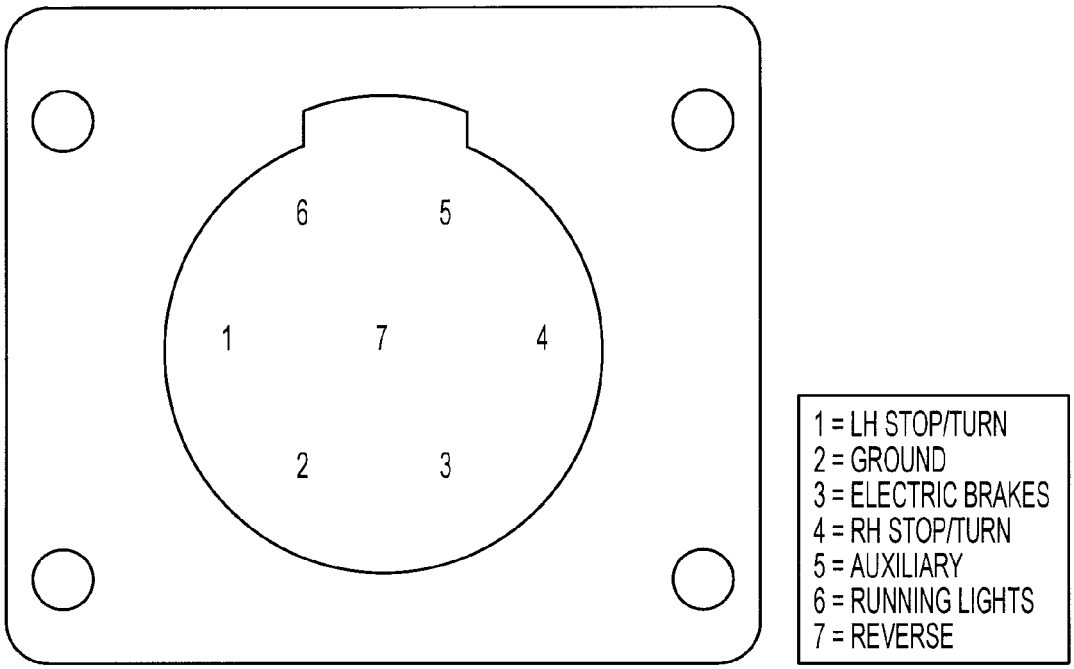
FIG. 16 is an exemplary wiring/contact diagram for a seven-way connector.

Referring to FIG. 16, an exemplary seven-way electrical connector wiring/contact diagram for a vehicle towed apparatus is shown. According to the wiring/contact diagram, the electrical contact in position 1, located at 9 o'clock in the illustration, may provide the electrical connection for controlling the left-hand stop/turn light. Similarly, as shown the contact at position 2 may be the ground contact. The remaining contact positions, 3 through 7, according to the exemplary wiring/contact diagram are for the electric brakes, right-hand stop/turn light, auxiliary, running lights and reverse indicator respectively.

Figure 17:
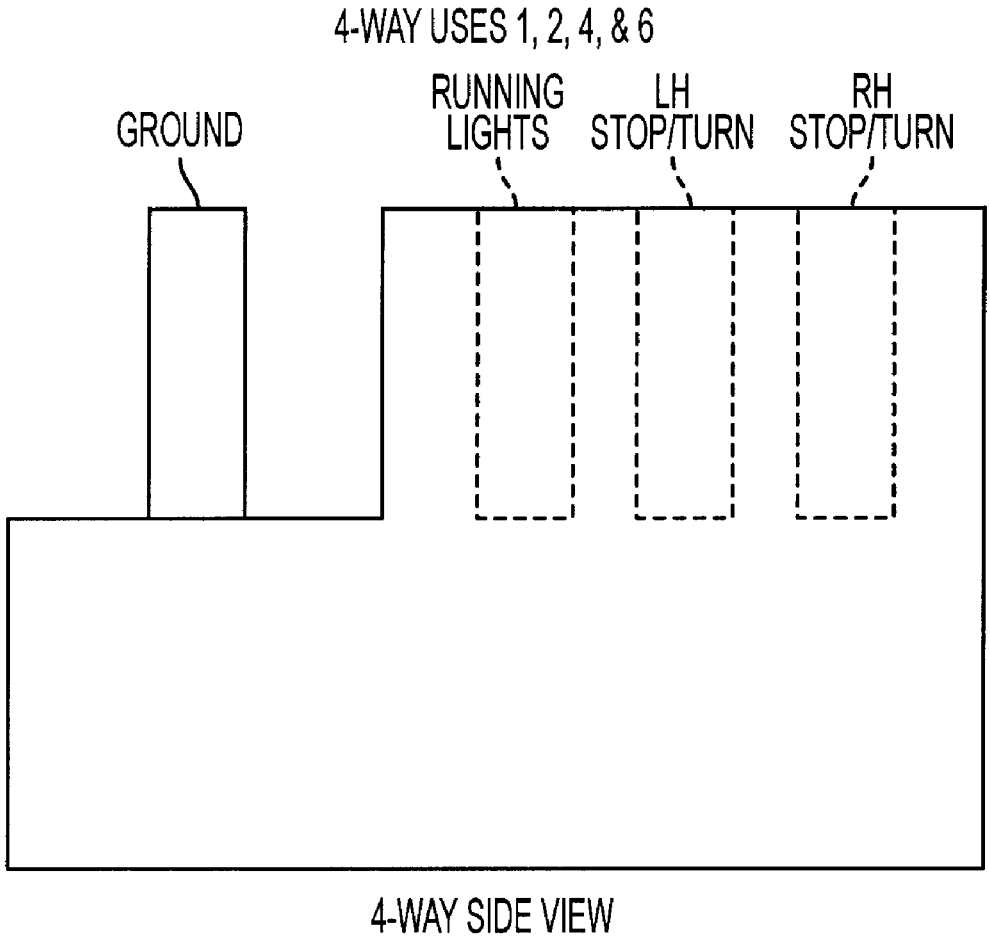
FIG. 17 is an exemplary wiring/contact diagram for a four-way connector.

Referring to FIG. 17, a corresponding wiring/contact diagram for an exemplary four-way connector interface is shown. From left to right the contacts of the exemplary connector are for the ground, running lights, left-hand stop/turn, and right-hand stop/turn.

From FIGS. 16 and 17 all of the electrical connections provided by the four-way connector interface are also provided by the seven-way connector interface. Consistent with the present invention, the circuits of the seven-way connector interface 302 and the four-way connector interface 304 are combined in a manner that requiring only a single wire harness. That is, one combined connector accommodates all of the circuits. According to one aspect, the present invention achieves the combination of circuits by placing the terminal bus at two or three different levels. This multi-level terminal bus arrangement obviates the need for a printed circuit board. Additionally, the connector may be suitable for high current applications.

Figure 14A:
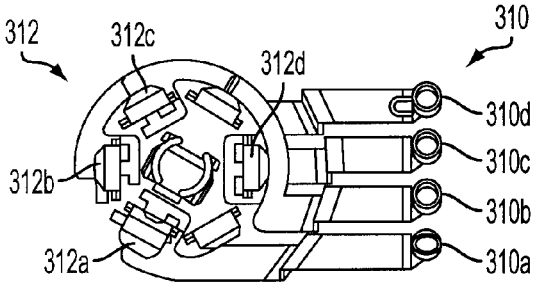
FIGS. 14*a* though 14*e* show an exemplary terminal layout in various views for a combination connector consistent with the present invention.
Figure 14B:
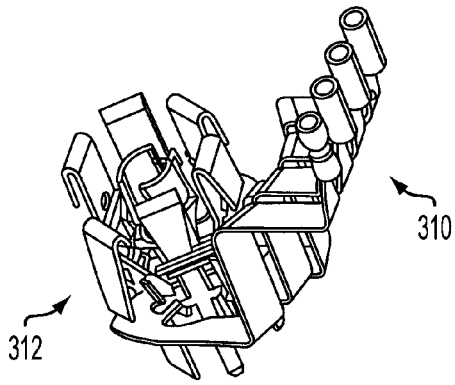
Figure 14C:
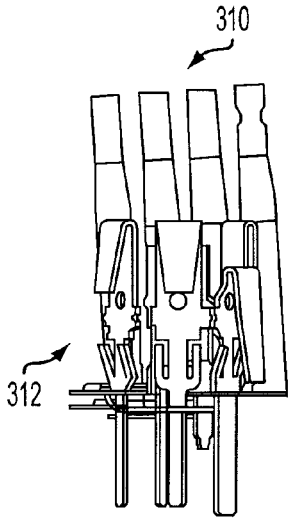
Figure 14D:
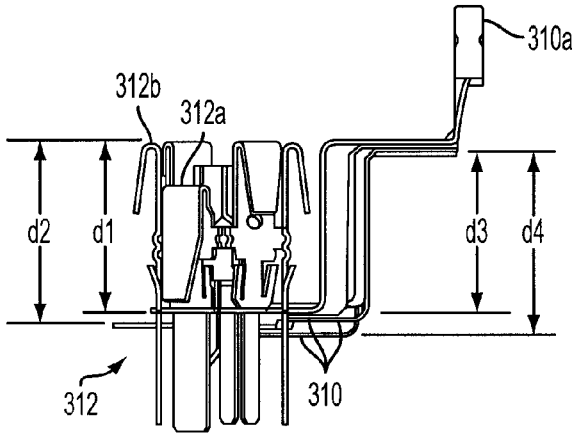
Figure 14E:
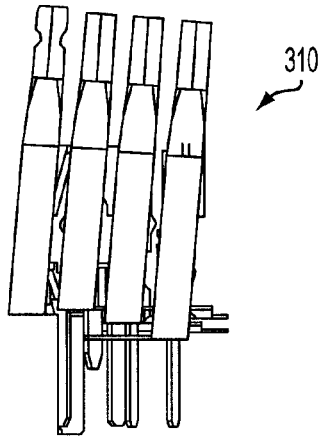

Referring to FIGS. 14*a* through 14*e*, an exemplary terminal layout for the connector 300 is shown in top, front, right, left, and perspective views. The terminals 310 of the four-way connector interface are coupled to the terminals 312 of the seven-way connector interface, thereby forming separate terminal buses. As best shown in FIGS. 14*d* and 14*e*, the each of the terminals 310 is coupled to an associated one of the terminals 312.

To accommodate the connections, the respective terminals 310 connect to the terminals 312 at a two or more different associated positions or levels along the lengths of the terminals 312. For example, terminal 310*a* is coupled to the terminal 312*a* at a distance d1 from the top of the terminal 312*b*, the terminal 310*b* is coupled to the terminal 312*b* at a distance d2 from the top of the terminal 312*b*, the terminal 310*c* is coupled to the terminal 312*c* at a distance d3 from the top of the terminal 312*b*, and the terminal 310*d* is coupled to the terminal 312*d* at a distance d4 from the top of the terminal 312*b*. The distances d1, d2, d3, and d4 in the illustrated exemplary embodiment are different distances, thereby placing the connections between the terminals 310 and 312 at different levels or positions. Advantageously, a single wiring harness may be coupled to the terminals 312 to establish electrical connections to both the terminals 312 and the terminals 310.

Figure 15:
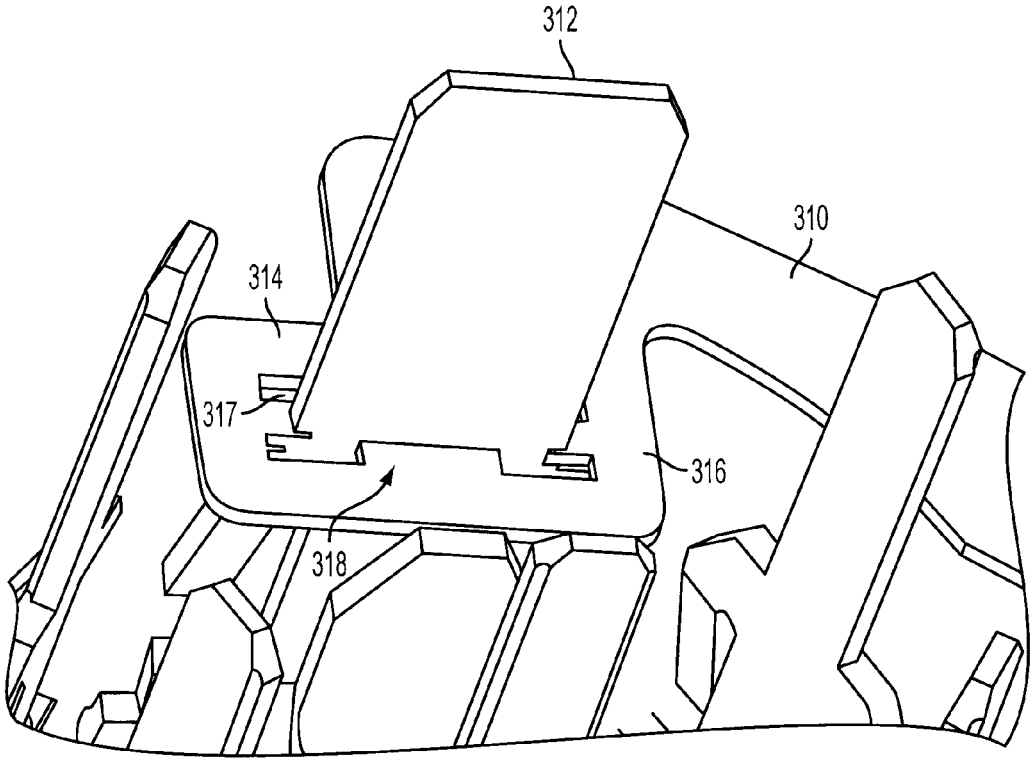
FIG. 15 is an enlarged perspective view of a spring finger feature that may be used to connect terminals in a combination connector consistent with the present invention.

Turning next to FIG. 15, the terminals 310 of the four-way connector interface and the may be secured to the terminals 312 of the seven-way connector interface by spring finger features 314. In the illustrated embodiment, the spring finger features 314 generally include a surround portion 316 including an opening 317. The spring finger feature 314 further includes a plurality of tabs 318 extending into the opening 317 of the surround portion 316.

Connection between the terminals 310, 312 may be made by inserting the terminal 312 at least partially though the opening 317. The tabs 318 may extend into the opening 317 sufficiently that tabs 318 are in contact with the terminal 312 when the terminal is at least partially received in the opening 317. Advantageously, the tabs 318 may extend into the opening 317 far enough that the tabs 318 are at least partially deflected by the presence of the terminal 312 in the opening. Such deflection of the tabs 318 by the terminal 312 may result in either elastic deformation or plastic deformation of the tabs 318.

The use of spring finger features for securing the terminals of the respective connector interfaces ensures reliable connections between the terminals. Additionally, the spring finger connection features may allow the terminals to be assembled after molding of the connector, without compromising the ability to produce a reliable connection between the terminals.

Figure 19:
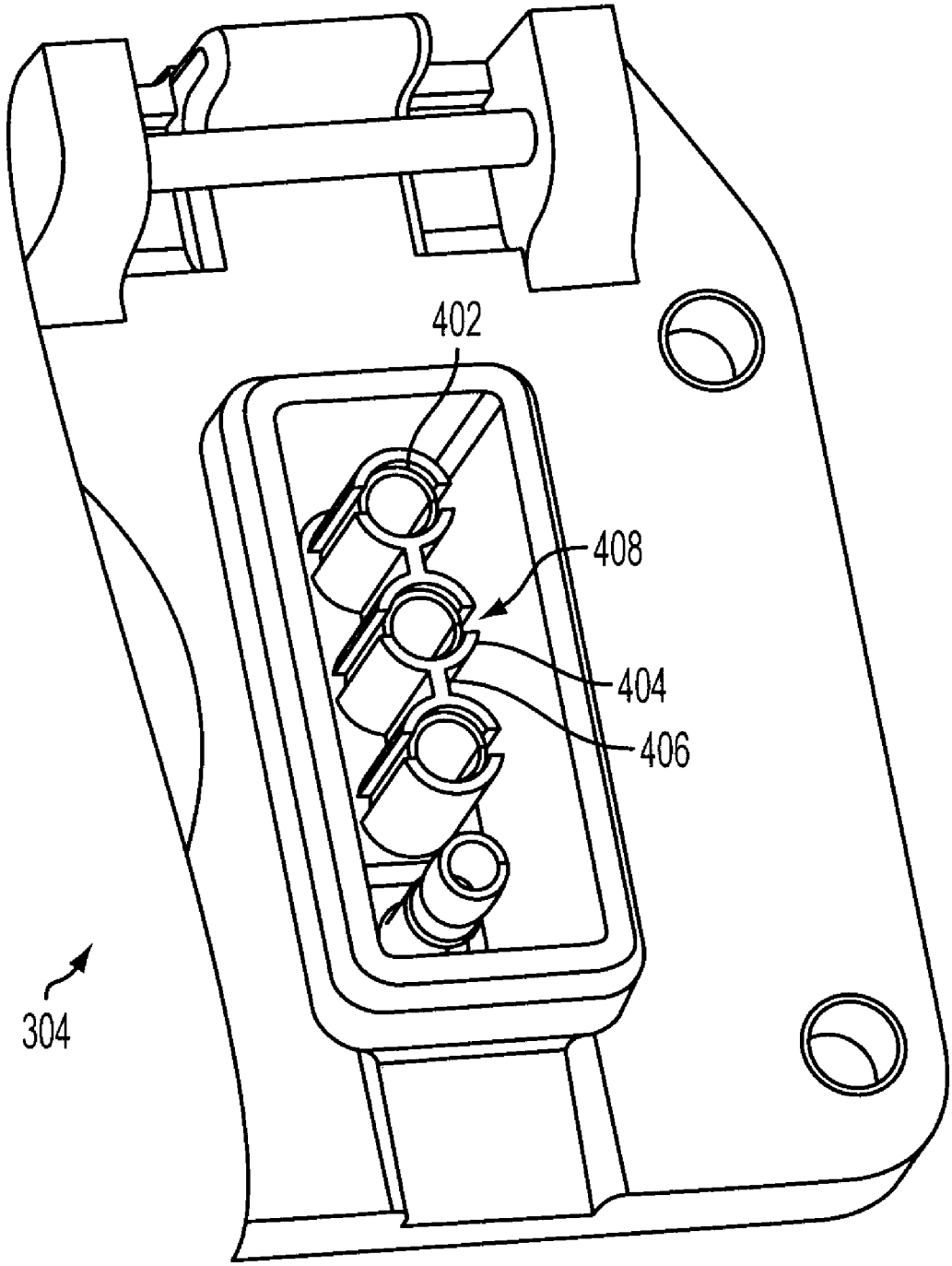
FIG. 19 is an enlarged perspective view of a four-way connector portion consistent with the present invention.

Referring to FIG. 19, a detailed view of one exemplary embodiment of the four-way connector portion 304 is shown. In the illustrated embodiment, the female barrel contacts 402 of the four-way connector interface 304 include walls 404 around the contacts 402. The walls 404 may serve to isolate the individual contacts 402 and/or to protect the contacts 402. As illustrated, the walls 404 may include webs 406 extending between adjacent walls 404.

In some embodiments consistent with the present invention, the walls 404 may include slots or windows 408. The windows 408 may allow the female contacts 402 to expand when receiving a mating plug by allowing the walls 404 to deflect. As illustrated, the windows 408 may be arranged orthogonal to the line of the contacts 402, thereby maintaining electrical isolation between the contacts 402 even when they are expanded.

Figure 13:
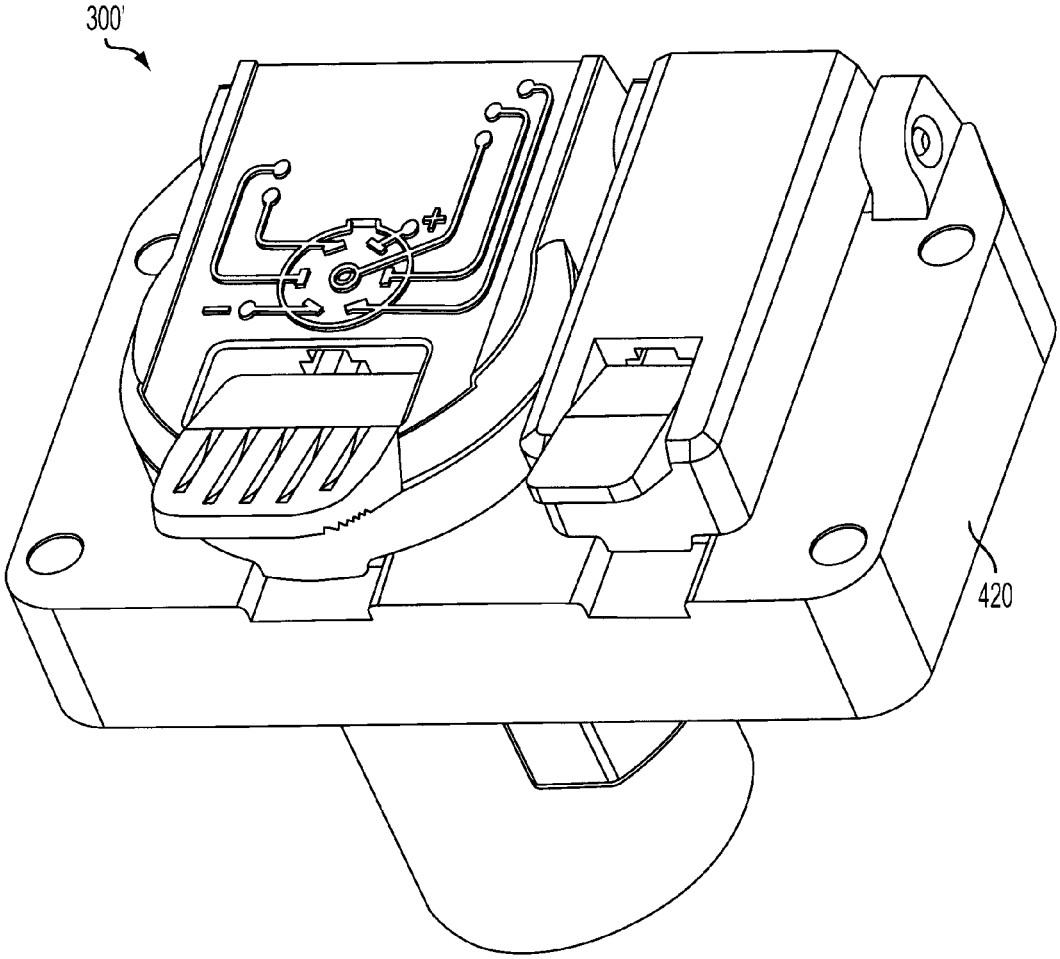
FIG. 13 is a perspective view an another exemplary combination connector consistent with the present invention.
Figure 18A:
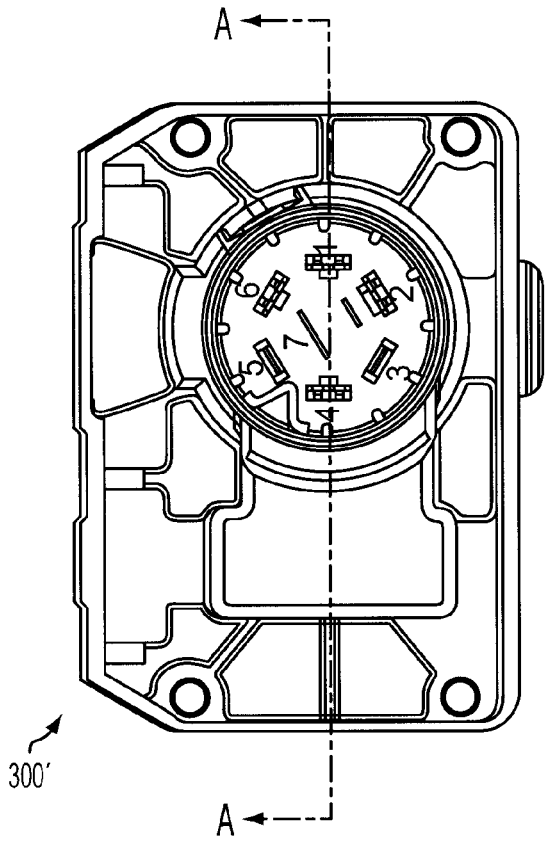
FIGS. 18*a* and 18*b* depict an exemplary combination connector consistent with the present invention in back-side elevation and sectional view.
Figure 18B:
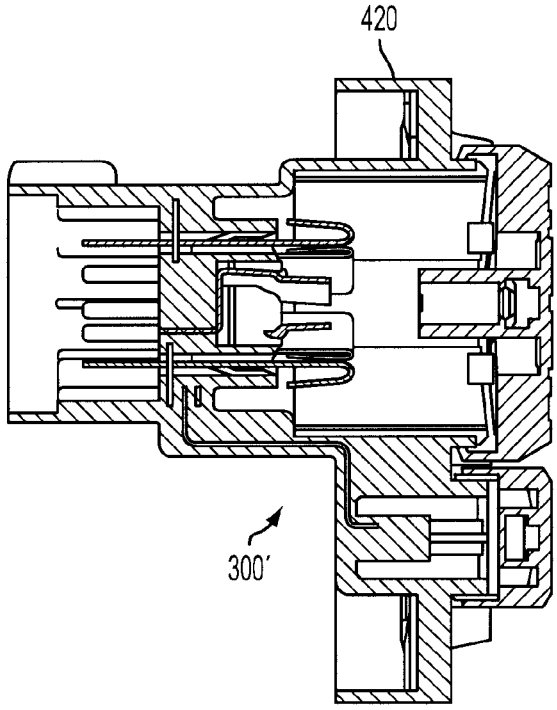

Referring particularly to FIGS. 13 and 18*b*, a skirt 420 may be added around at least a portion of the connector 300. The skirt 420 may provide the connector 300 with a uniform mounting surface about the perimeter of the connector 300. The skirt 420 may, therefore, eliminate the need to provide a mounting bracket where the connector sits.

It should be understood that the features described above in connection with FIGS. 1-10 may be incorporated into the four way portion of the combined connector of FIGS. 11-19. Advantageously, therefore, there is provided a combined connector that eliminates the need for an adapter, while allowing cost-effective production and resistance to corrosion.

According to another aspect, a combination connector consistent with the present invention may include a cover, such as described with reference to FIGS. 1-10, protecting each connector portion of the combination connector. More particularly, the combination connector may include a cover for each connector portion wherein opening one cover to access one connector portion inhibits simultaneously opening and accessing another connector portion. This aspect may reduce the likelihood that more than one connector will be used at the same time. Accordingly, the chance of exceeding a maximum current draw for the connector wire harness may be reduce, thereby reducing the occurrence of a blown fuse or fire resulting from excessive heat build up.

Figure 20:
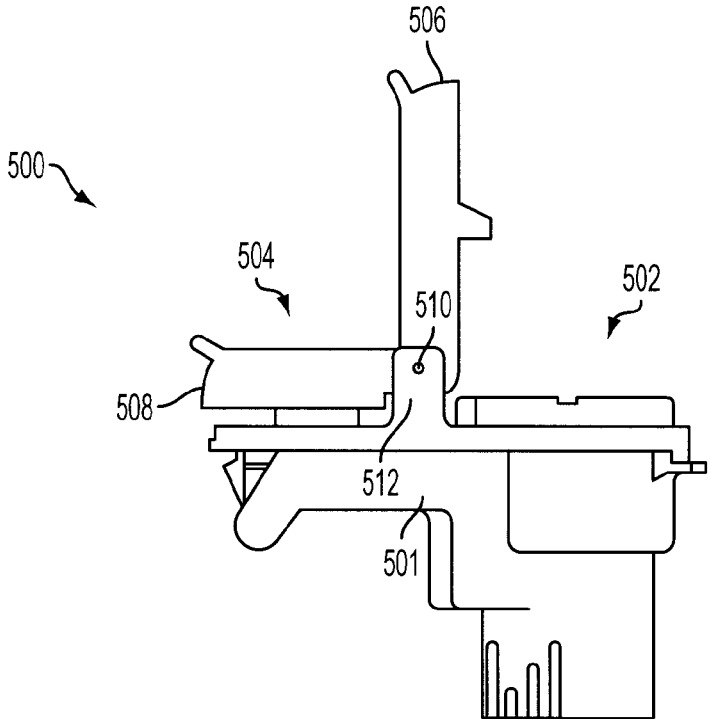
FIGS. 20 and 21 depict a combination connector having a common hinge design consistent with the present invention.
Figure 21:
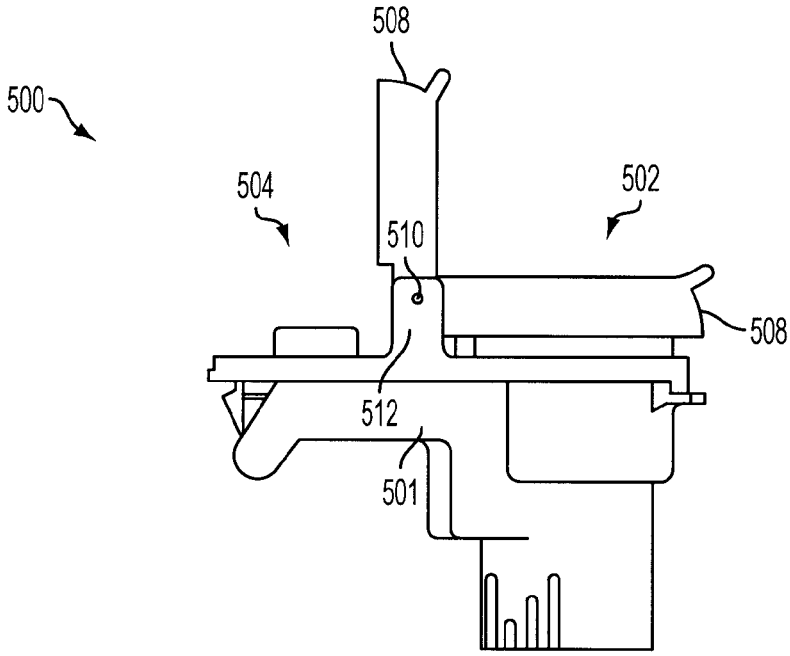
Figure 22A:
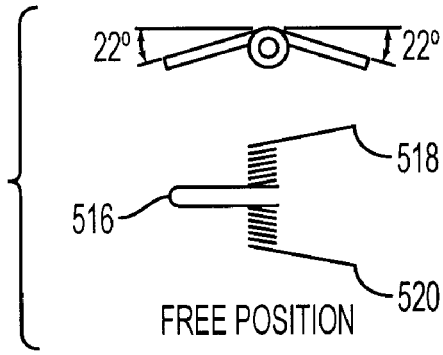
FIGS. 22*a*-22*c* depict an exemplary spring mechanism that may be used with a common hinge design consistent with the present invention.
Figure 22B:
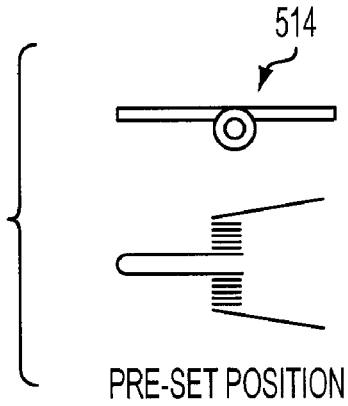
Figure 22C:
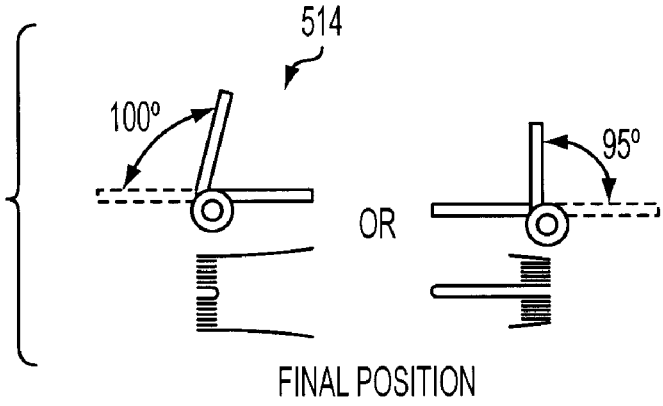

Referring to FIGS. 20 and 21, an exemplary combination connector 500 having a cover arrangement consistent with this aspect of the invention is illustrated. The exemplary connector 500 includes a first connector portion 502, such as a seven-way connector interface, and a second connector portion 504, such as a four-way connector interface. Each connector portion 502, 504 includes a respective cover 506, 508 which may be opened to access the connector portions 502, 504.

In the illustrated embodiment, the covers 506, 508 are pivotally attached to the connector 500 via a common hinge. The common hinge may include a hinge pin 510 extending through a clevis 512 on the connector body 501 and through each respective cover 506, 508. The hinge arrangement may be similar to the hinge arrangement of the cover illustrated in FIGS. 1 though 10.

Similar to the hinge arrangement described above, preferably each cover 506, 508 is spring biased toward a closed configuration. Because both of the covers share a common point of rotation and hinge pin 510, a single spring may advantageously be used to bias both of the covers 506, 508 toward respective closed configurations. Referring to FIGS. 21*a* though 21*c*, an exemplary spring 514 configured to simultaneously bias both covers 506, 508 is shown. The spring 514 may be generally configured as a torsion spring. The spring 514, however may include a bight 516 or extending loop in the central part of the spring 514. In the manner of a conventional torsion spring, the spring 514 may also include extending ends 518, 520. The bight 516 may engage and bias one cover 504, while the end 518, 520 engage and bias the other cover 502.

Still referring to FIGS. 21*a*-21*c*, in the free or unstressed configuration of the spring 514 the bight 516 and ends 518, 520 may be angled at least slightly downward. In the pre-set position, i.e., installed position, shown in FIG. 21*b*, the spring 514 is slightly stressed, thereby urging the respective covers 506, 508 each toward a closed configuration. As shown in FIG. 21*c*, the spring may be further flexed allowing the covers 506, 508 to be opened.

It should be appreciated that when one cover, e.g., 506, is opened, the stress of flexing the spring 514 is transmitted to the other cover 508, thereby increasing the closing force action on the cover 508. It, therefore, requires greater force to open both covers at the same time than the force required to open only a single cover. The use of a single spring 514 consistent with the exemplary embodiment, therefore, may further inhibit opening both covers 506, 508 at the same time.

While the use of a single spring is more cost effective than using two individual springs, and may provide an impediment to opening both covers at the same time, those having skill in the art will appreciate that the objects of the this aspect may also be accomplished using two or more springs.

Figure 23:
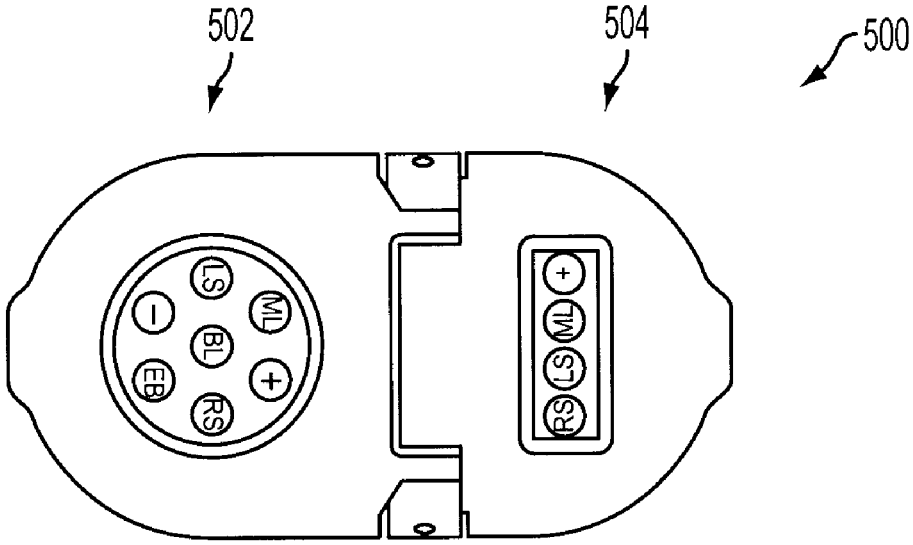
FIGS. 23 and 24 depict a plan view of an exemplary connector having a symmetrical mounting footprint.
Figure 24:
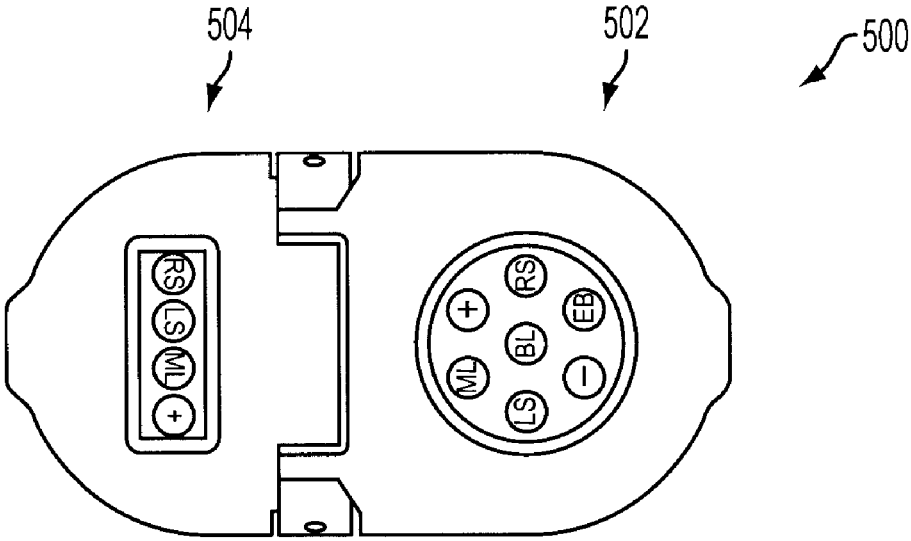
Figure 25:
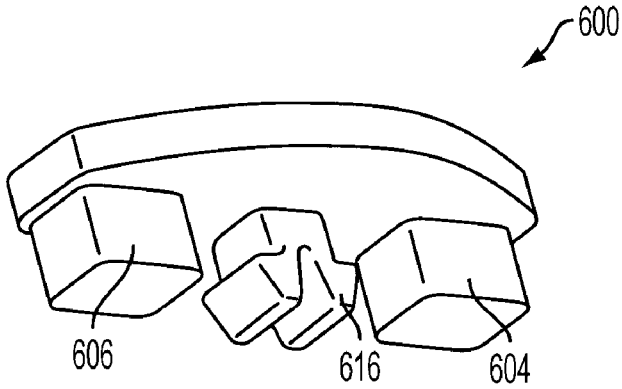
FIG. 25 is a perspective view of an exemplary locking tab consistent with the present invention.

Referring to FIGS. 23 and 24 it may be advantageous to configure the combination connector 500 as a symmetrical package from a mounting perspective. In the illustrated embodiment, while the covers are not the same size and shape and the hinge is not located in the center of the connector 500, the overall footprint of the connector 500 is symmetrical. This configuration imparts greater mounting flexibility. As shown, the same mounting features may allow the connector 500 to be rotated 180 degrees without necessitating different mounting features.

Figure 28:
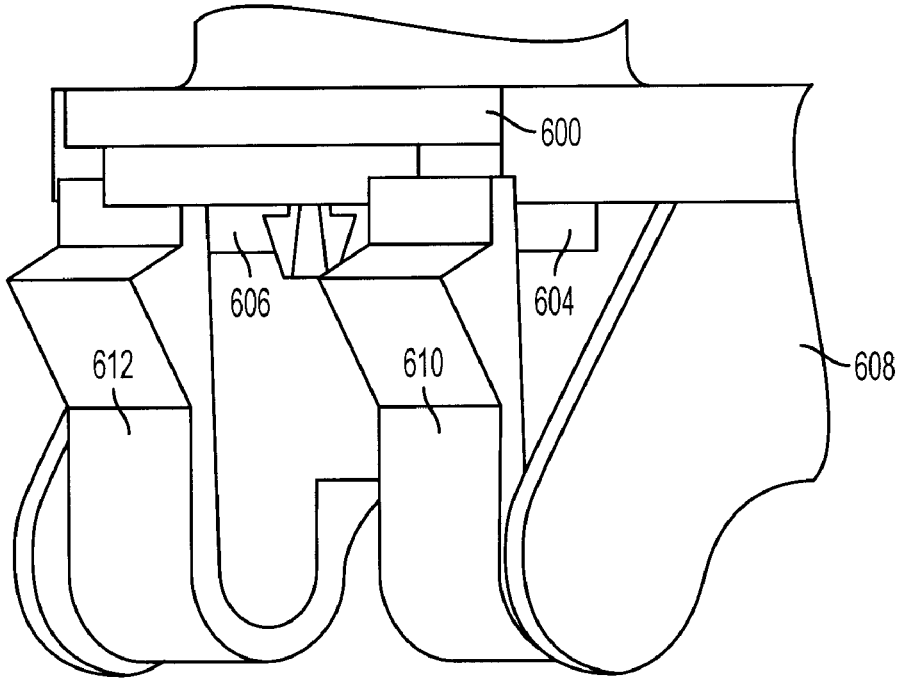
Figure 29:
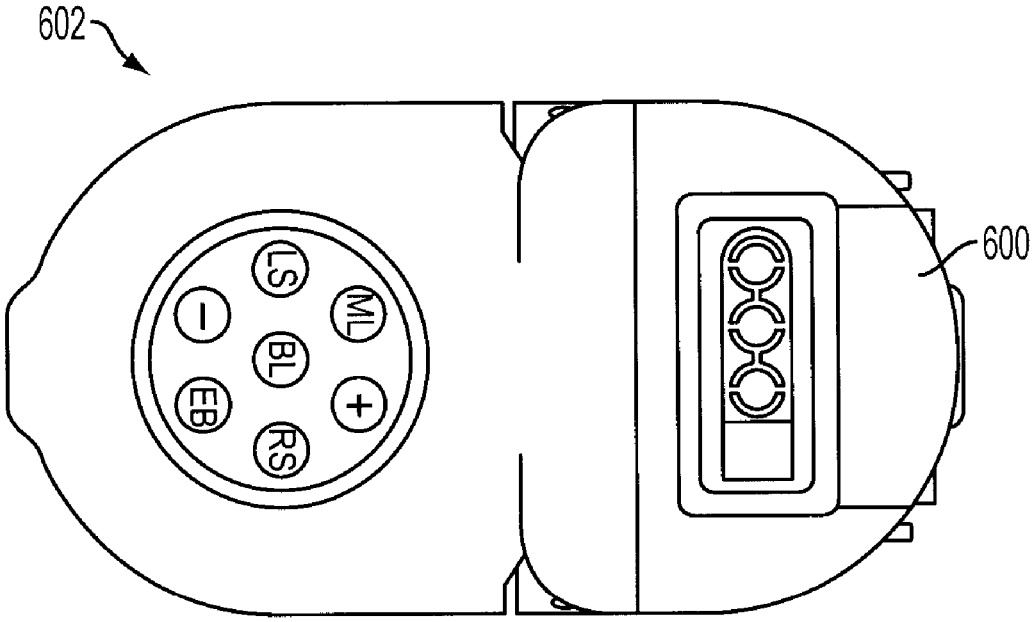
Figure 32:
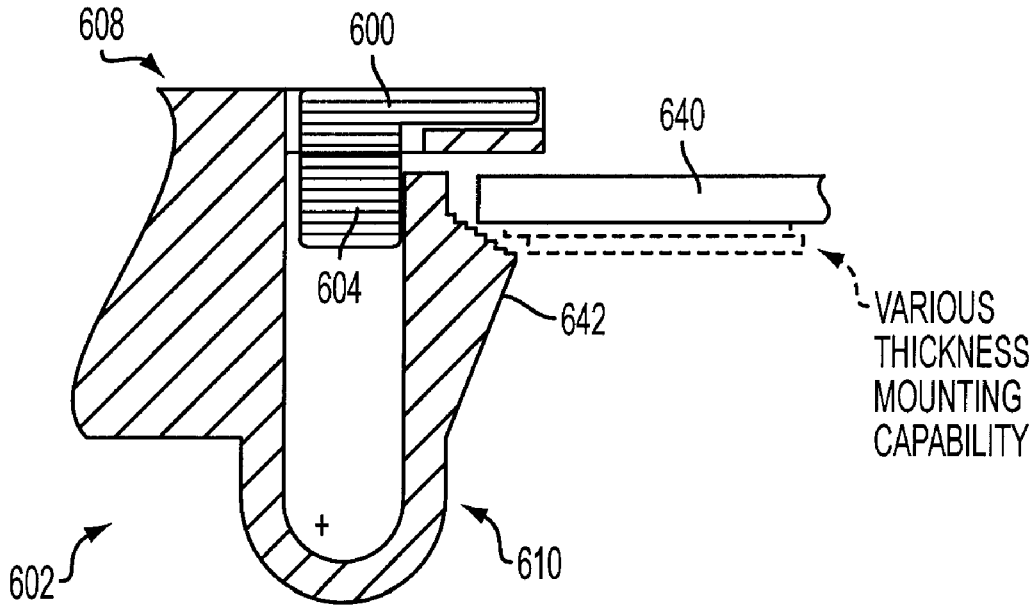
FIG. 32 is a representational drawing showing a locking tab deployed on a combination connector in a manner consistent with the present invention.

As best shown in FIGS. 28 and 32, the connector 602 may utilize snap-fit features 610, 612 for mounting the connector 602, e.g., to a mounting feature 640, such as a bracket, bumper, etc. The snap-fit features 610, 612 may be disposed on the connector housing 608 and extending therefrom. In operation, the connector 602 may be inserted into a mounting feature 640 causing the snap-fit features 610, 612 to resiliently deflect, e.g., toward the connector body 608 in the illustrated embodiment, as a protrusion portion 642 passes the mounting feature 640. Once the protrusion portion 642 has cleared the mounting feature 640, the snap-fits 610, 612 resiliently recover, whereby an upper surface of the protrusion portion 642 is disposed adjacent the mounting feature and inhibits extraction of the connector.

Turning to FIGS. 25 through 32, a locking tab 600 is shown that may be used in conjunction with a combination connector 602. When installed, as shown, e.g., in FIGS. 26-29, the locking tab 600 may inhibit removal of the connector 602 from a vehicle mounting bracket (not shown).

Figure 26:
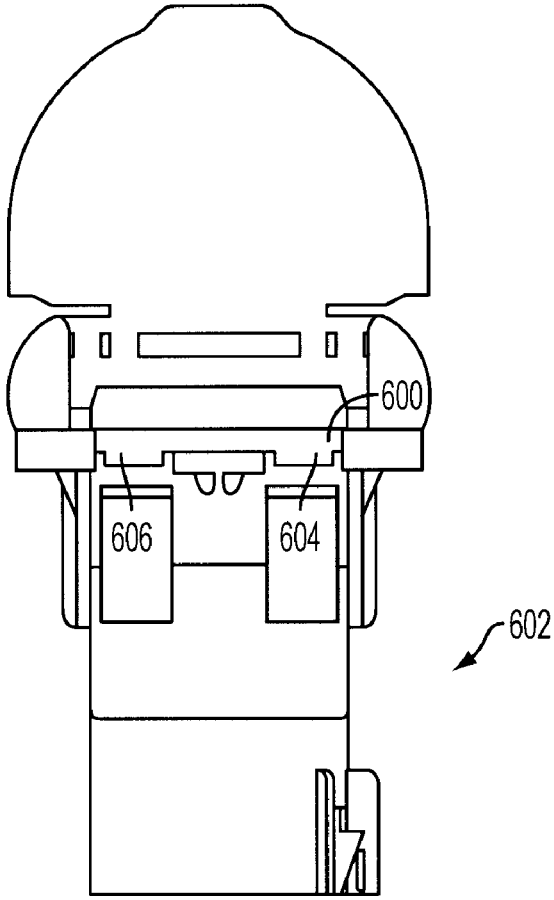
FIGS. 26-29 variously show an exemplary locking tab deployed on a combination connector consistent with the present invention.
Figure 27:
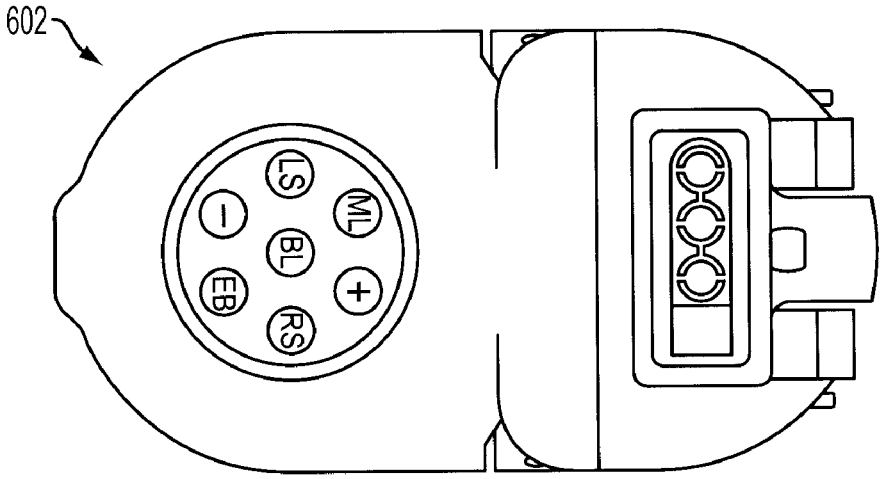

As best seen in FIGS. 26, 28, and 32 when the locking tab 600 is assembled to the connector 602 the two support legs 604, 606 are positioned between the connector body 608 and the connector snap-fits 610, 612. Accordingly, once the locking tab 600 is in position the connector snap-fits are inhibited from deflecting to allow the release of the connector 602 from the vehicle mounting feature. The center snap feature 616 of the locking tab 600 may be received in a corresponding feature of the connector. The center snap feature 616 may retain the locking tab to the connector 602, thereby preventing easy removal of the locking tab 600, itself, from the connector 602.

Figure 31A:
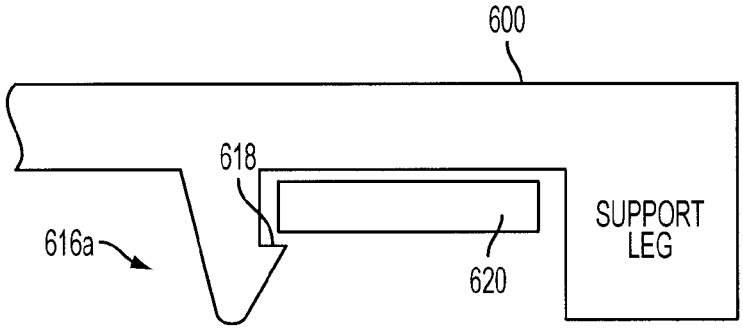
FIGS. 31*a* and 31*b* respectively show an exemplary single-stage and an exemplary dual-stage locking tab consistent with the present invention.

The center snap feature 616 of the locking tab 600 may be provided for either single-stage operation or dual-stage operation. As schematically illustrated in FIG. 31*a*, a single-stage locking tab 600 may include a center snap feature 616*a* having only a single barb 618. Accordingly, the center snap feature 616 is either not engaged with corresponding housing member 620, or is fully engaged with housing member 620, as shown.

Figure 31B:
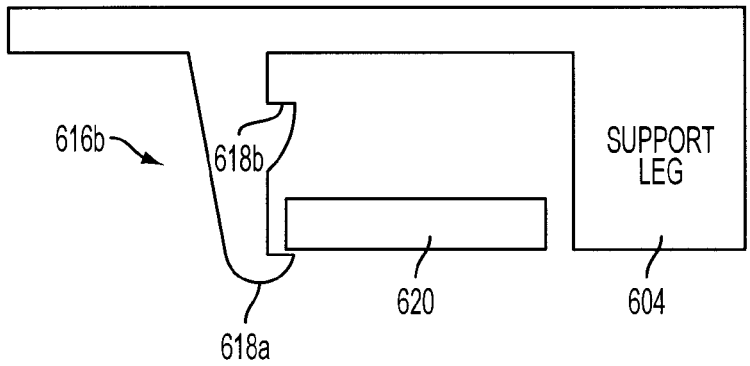

Referring to FIG. 31*b*, a dual-stage center snap feature 616*b* is shown. The dual-stage center snap feature 616*b* includes two barbs 618*a*, 618*b*. When only the first barb 618*a* is engaged with the housing feature 620, the support legs 604, 606 are disposed between the connector body and connector snap-fits, but the locking tab is retained to the connector 602. Accordingly, when the dual-stage center snap feature 616*b* is in a first stage of engagement, the locking tab is retained to the connector 602 and the connector snap-fits may be freely deflected. Once the connector 602 has been mounted in a vehicle mounting bracket, the locking tab 600 may be fully engaged, thereby positioning the support legs 604, 606 between the connector housing and the snap-fits, thereby preventing deflection of the snap-fits and the removal of the connector 602 from the mounting bracket.

Figure 30:
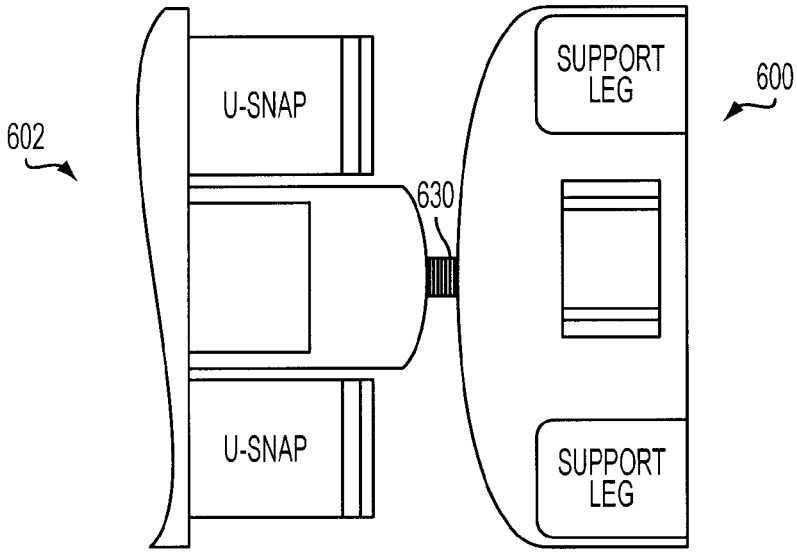
FIG. 30 schematically depicts an exemplary locking tab connected to a combination connector via a living hinge.

While the dual stage locking tab may retained to the connector without fully engaging the snap-fits, additional accommodations are available in the case of a single-stage locking tab. A living hinge or tear-away feature may be used in conjunction with a single-stage locking tab to prevent separation of the locking tab from the connector before the locking tab is deployed, e.g., before installation of the connector on a vehicle. Referring to FIG. 30, an exemplary embodiment of a locking tab 600 retained to a connector 602 by a web 630 of plastic. Desirably, the web 630 may have a small cross-sectional area, may be scored, etc. so that the locking tab may be readily separated from the connector 602.

Consistent with this aspect of the invention, when a connector 602 is to be mounted to a vehicle, the locking tab 600 may be separated from the connector 602, as by cutting, tearing, breaking, etc. The connector 602 may be disposed in the mounting bracket such that the connector 602 is retained in position by the connector snap-fits 610, 612. The locking tab 600 may then be deployed to prevent deflection of the snap-fits 610, 612 and extraction of the connector 602 from the vehicle mounting bracket.

Additionally, the locking tab may be formed having an undercut region. The undercut region may provide access by a tool, such as a screw driver, for removal of the locking tab to facilitate the removal of the connector.

Figure 33A:
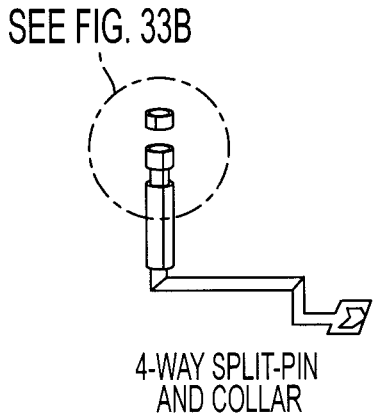
FIG. 33 is an enlarged perspective view of a female terminal consistent with the present invention.
Figure 33B:
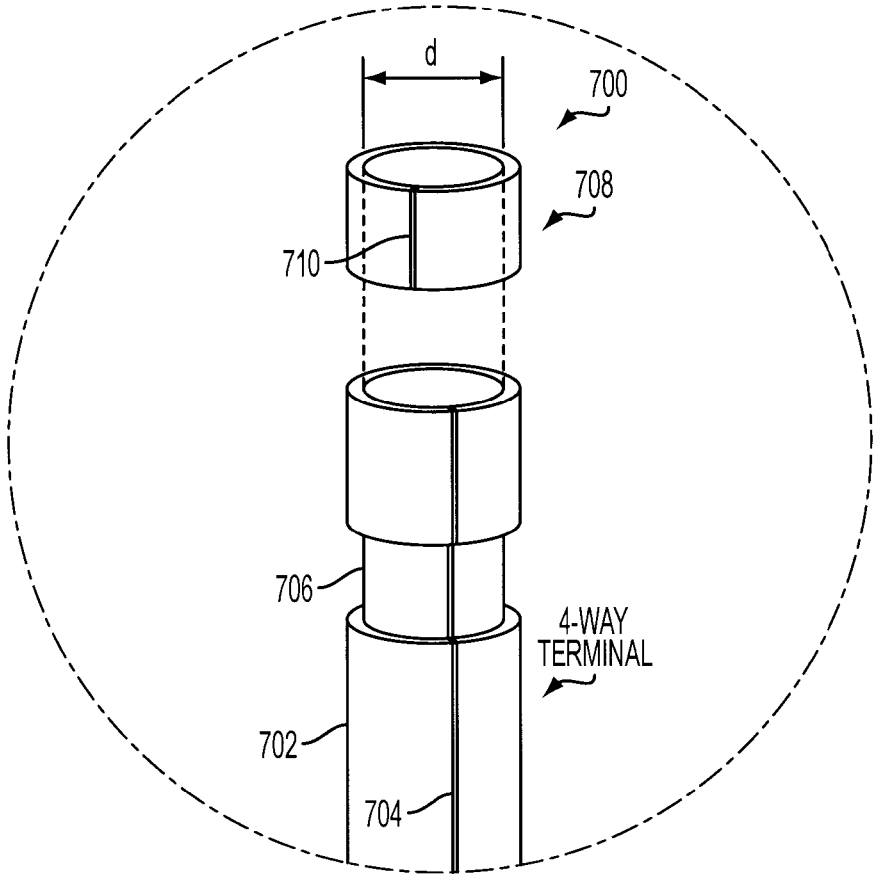

According to another aspect, the invention provides a female terminal or contact that may provide improved life span. An exemplary terminal 700 consistent with the present invention is shown in FIG. 33. The terminal 700 generally comprises a cylindrical member 702 having a longitudinal slot 704 extending axially therein to facilitate expansion of the terminal 700 upon insertion of a plug (not shown). The distal end of the terminal 700 may include a circumferential indentation 706. A collar 708 is adapted be disposed in the indentation 706.

The collar 708 may be formed from a resilient material, e.g., spring steel, or may be formed from a higher modulus material than terminal cylindrical member 702. As shown, the collar 708 may be a generally cylindrical member, and may also include an axial slot 710. Alternatively, the slot may be formed as a helical slot. In either case the inside diameter, d, of the collar 708 is capable of expanding. With this objective in mind, it should be understood that the collar may also include a helically wound wire or strip.

The collar 708 resists the expansion of the cylindrical member 702. When the collar is formed of a resilient material, the collar 708 may provide greater and more consistent contact force between the terminal 700 and an inserted plug over the life of the terminal. Additionally, the collar 708 limits spreading of the slot 704 in the terminal 700, which otherwise may limit the contact area between the terminal and a plug and reduce electrical contact/life. The use of a collar 708 may facilitate the insertion and extraction of a plug by maintaining a more uniform inside diameter, d, over the life of the terminal.

As discussed previously, a combination connector consistent with the present invention may include a terminal bus that is susceptible to assembly after molding the connector. For example, in the context of a combination 4-way interface and 7-way interface connector, the terminals may be connected using spring finger features.

Figure 34:
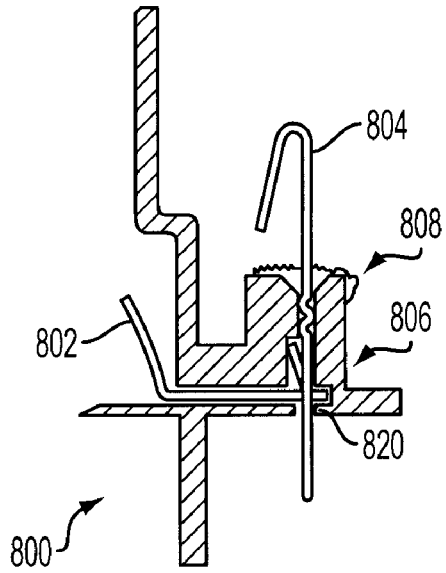
FIGS. 34 through 36 depict various embodiments of spring finger configurations for coupling connector terminals.
Figure 35:
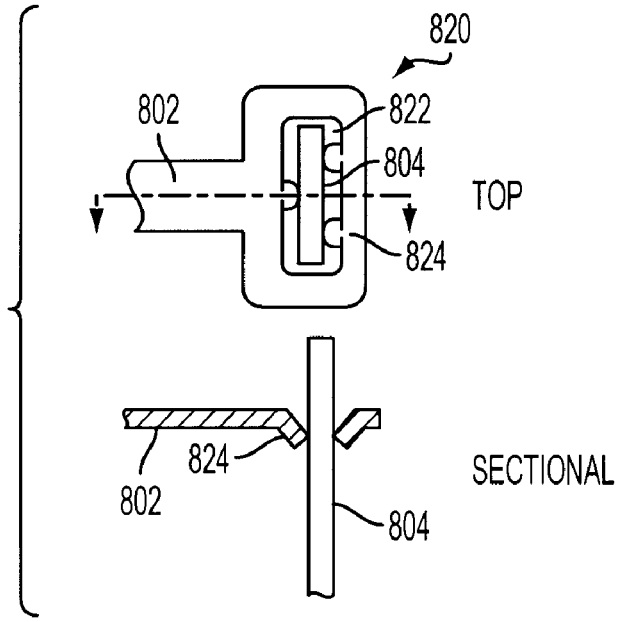
Figure 36:
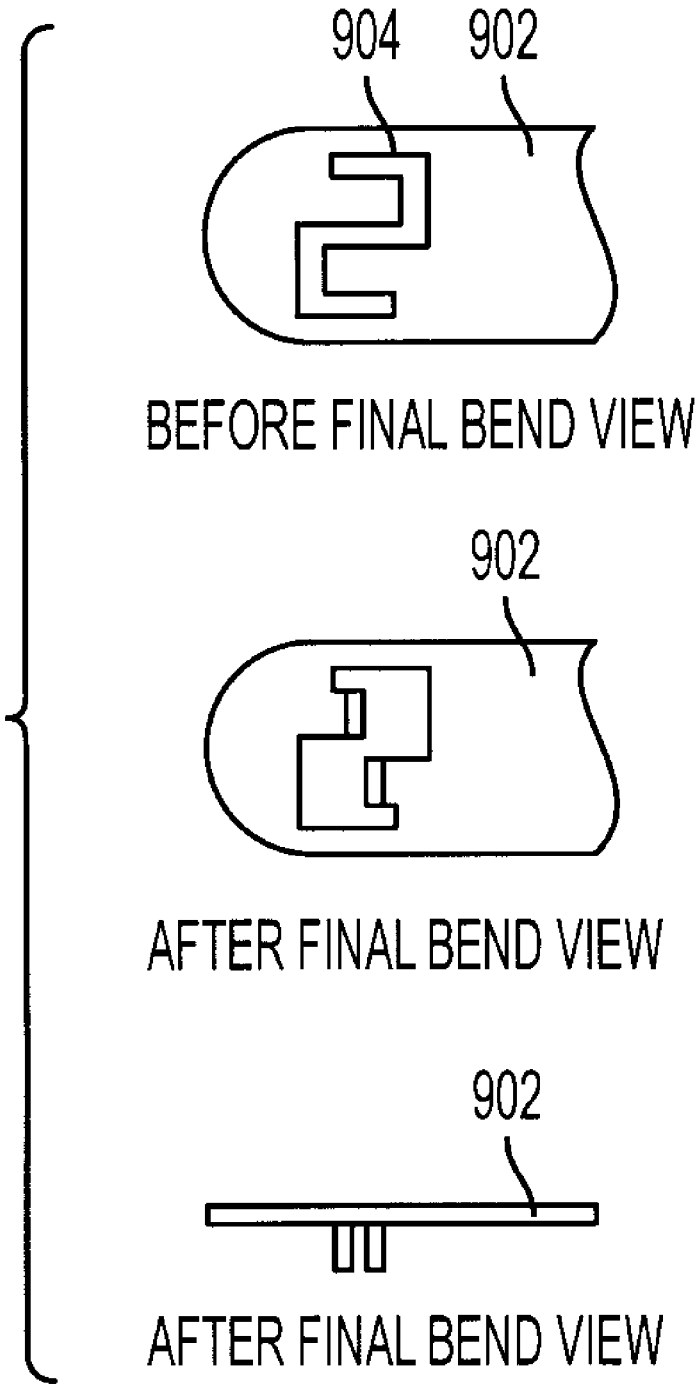

As illustrated in FIGS. 34 through 36, at least one of the four-way terminals 802 may be inserted molded with the connector body 800. After molding, a terminal 804 of the seven-way interface may be mechanically installed into the socket housing 806. When the seven-way terminal 804 is mechanically installed into the socket housing 806, the four-way terminal 802 and the seven-way terminal 804 are electrically coupled to one another. Once the seven-way terminal 804 is installed in the socket housing 806, the terminal 804 may be mechanically retained, for example, using an adhesive or heat staking, etc.

As previously discussed, electrical coupling between the four-way terminal 802 and the seven-way terminal 804 may advantageously be accomplished using a spring finger feature. FIG. 35 illustrates a top and sectional view of an exemplary spring finger feature 820 consistent with the present invention. In the illustrated embodiment, the four-way 802 terminal may define an aperture 822 sized to receive at least a portion of the seven-way terminal 804. The four-way terminal 802 may further include a plurality of spring fingers 824 projecting into the aperture 822 and in contact with the seven-way terminal 804. In the illustrated embodiment, three spring fingers 824 are in contact with the seven-way terminal 803, although more or less spring fingers may be used.

As illustrated in the sectional view of FIG. 35, preferably the spring fingers 824 project far enough into the aperture 822 such that when the seven-way terminal 804 is installed into the aperture 822 the spring fingers 824 are caused to bend or deflect. This may ensure that a secure electrical connection is made between the spring fingers 824 and the seven-way terminal 804. Desirably, the deflection or deformation of the spring fingers 824 is an elastic deformation, thereby providing a very secure electrical connection. Plastic deformation of the spring fingers 824, however, may also provide satisfactory electrical connection between the spring fingers 824 and the seven-way terminal 804.

Turning to FIG. 36, an alternative spring finger feature is illustrated. The four-way terminal 902 may include an "S" or reverse "S" slit 904. When the seven-way terminal (not shown) is installed the tabs formed by the slit 904 may deflect in response to the insertion force, thereby forming a secure mechanical and electrical connection between the terminal 902 and the seven-way terminal.

Figure 37:
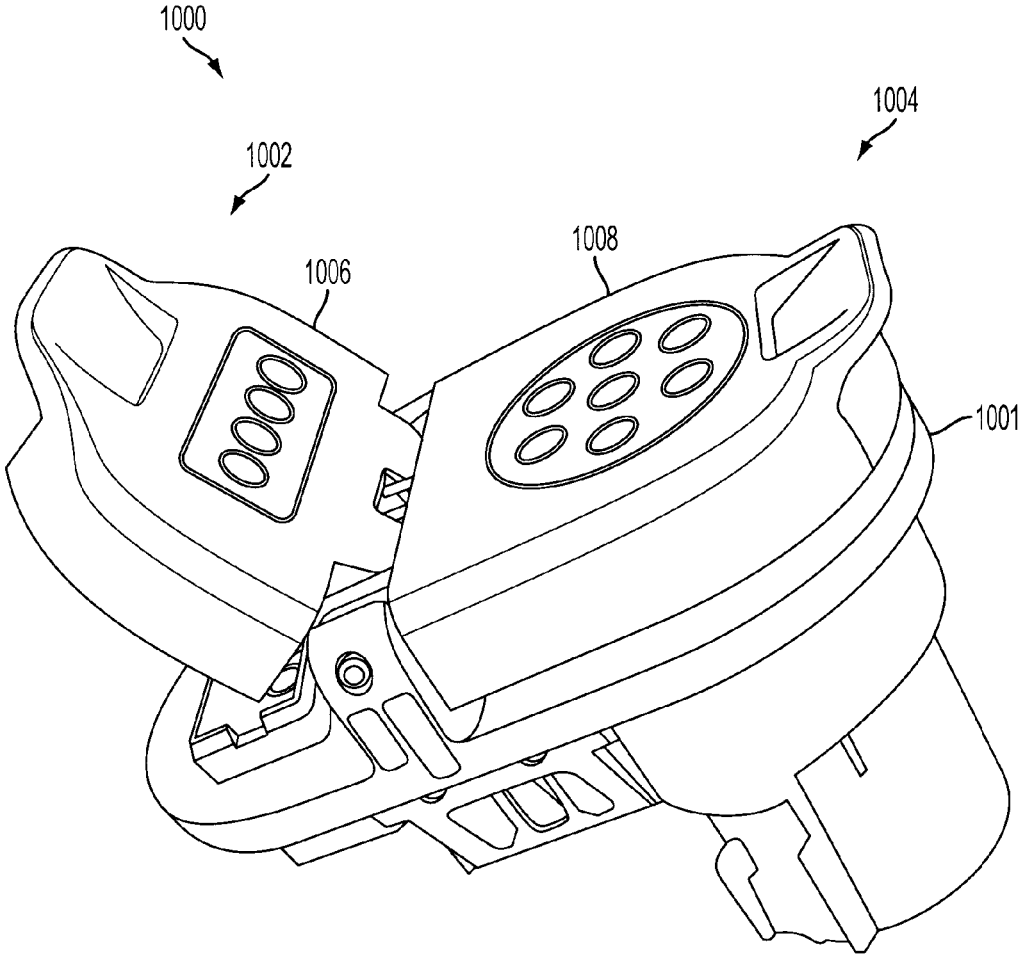
FIG. 37 is a perspective view of an embodiment of a combination connector consistent with the present invention.
Figure 38:
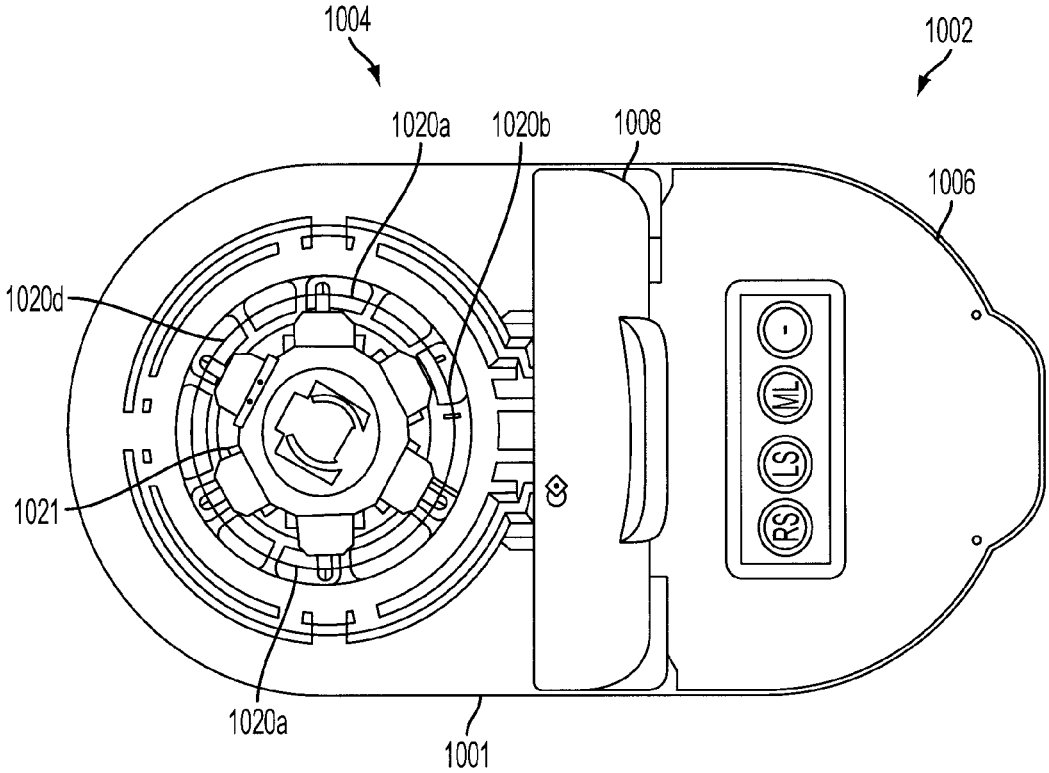
FIG. 38 is a top view of an embodiment combination connector consistent with the present invention.
Figure 39:
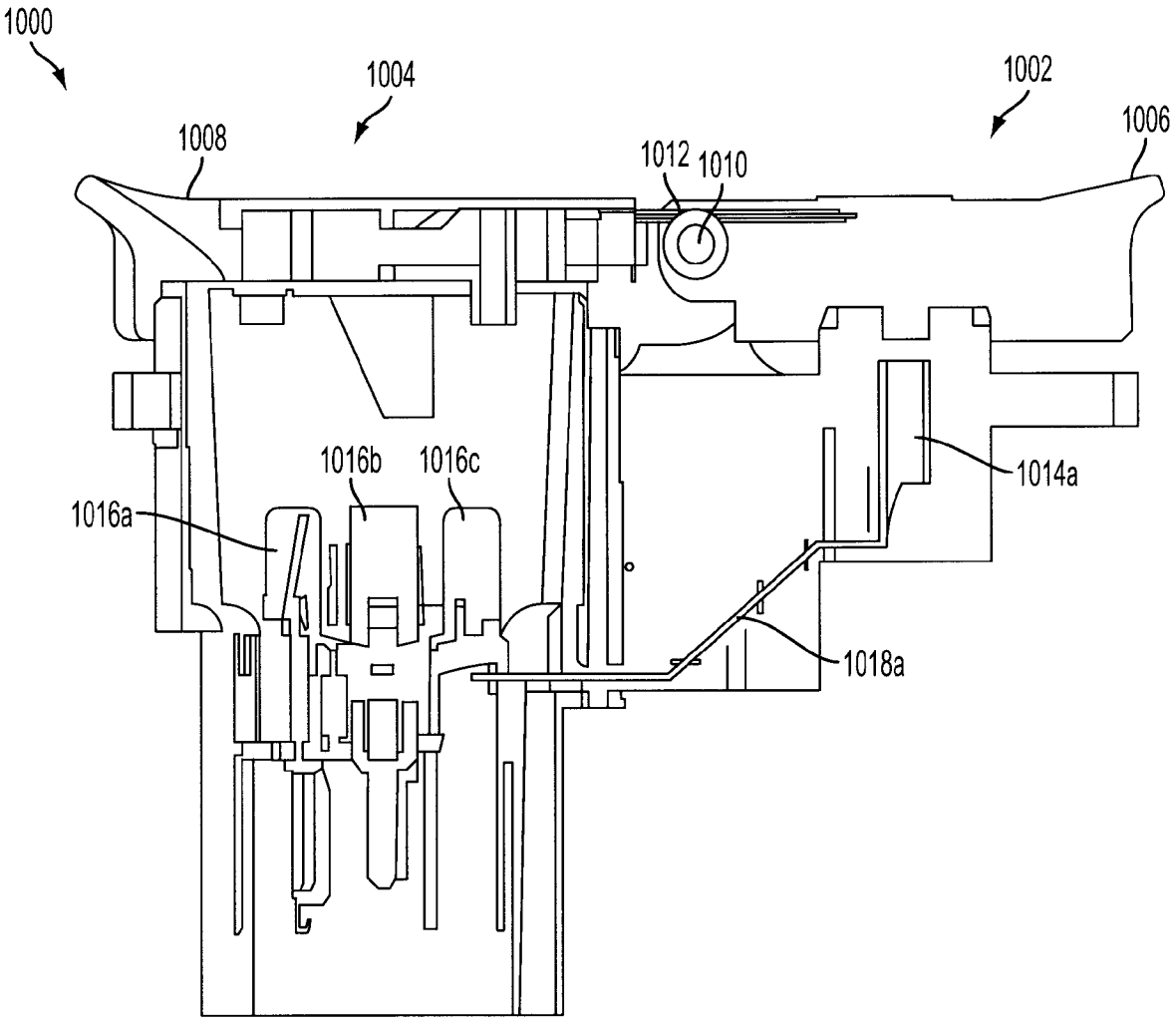
FIG. 39 is a cross-sectional view of an embodiment of a combination connector consistent with the present invention.

Referring to FIGS. 37 through 39, an embodiment of a combination connector 1000 is shown. Consistent with the illustrated embodiment, the combination connector may include body portion 1001 including a first connector region 1002 and a second connector region 1004. The first connector region 1002 may include a four-way connector and the second connector region 1004 may include a seven-way connector. Each of the connector regions 1002, 1004 may include a cover portion 1006, 1008, respectively. As depicted, the cover portions 1006, 1008 may be pivotally disposed over the respective connector portions 1002, 1004. The cover portions 1006, 1008 may be pivotally coupled to the body portion 1001 of the combination connector 1000 via a common hinge pin 1010. Additionally, the cover portions 1006, 1008 may each be biased toward a closed position by a single common spring 1012, as mentioned in connection with previous embodiments. The arrangement of the cover portion 1006, 1008 may be such that only one cover portion 1006, 1008 may be open at a time. In an embodiment herein, one cover portion being in an open position may prevent the other cover portion from opening. For example, as shown in FIG. 37 when one cover portion 1006 is in an open position, the cover portion 1006 may prevent the other cover portion 1008 from opening by restricting and/or preventing pivotal movement of the other cover closed cover portion 1008.

Figure 40:
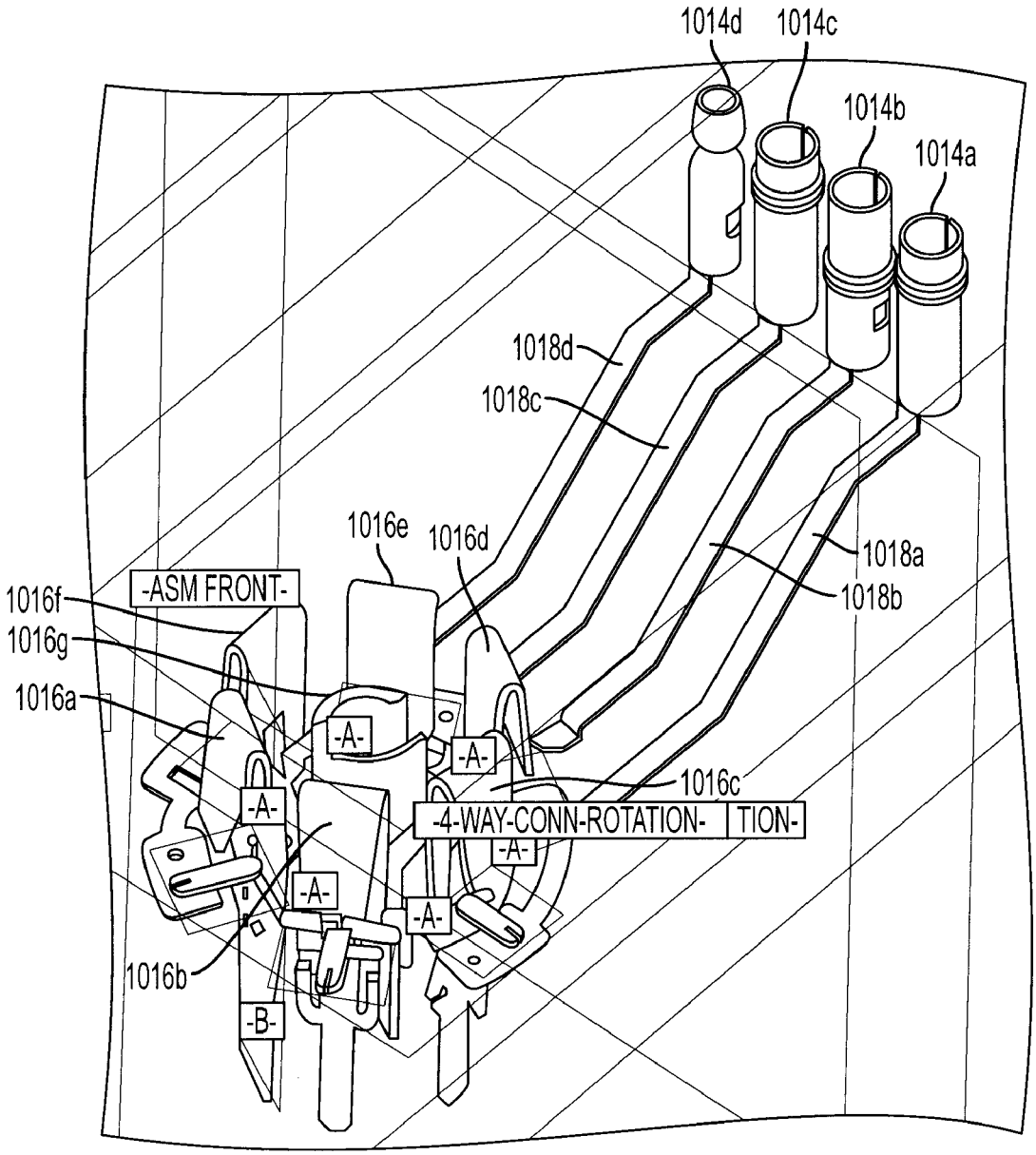
FIG. 40 schematically depicts a terminal and wiring bus arrangement of a combination connector consistent with the present invention.
Figure 41:
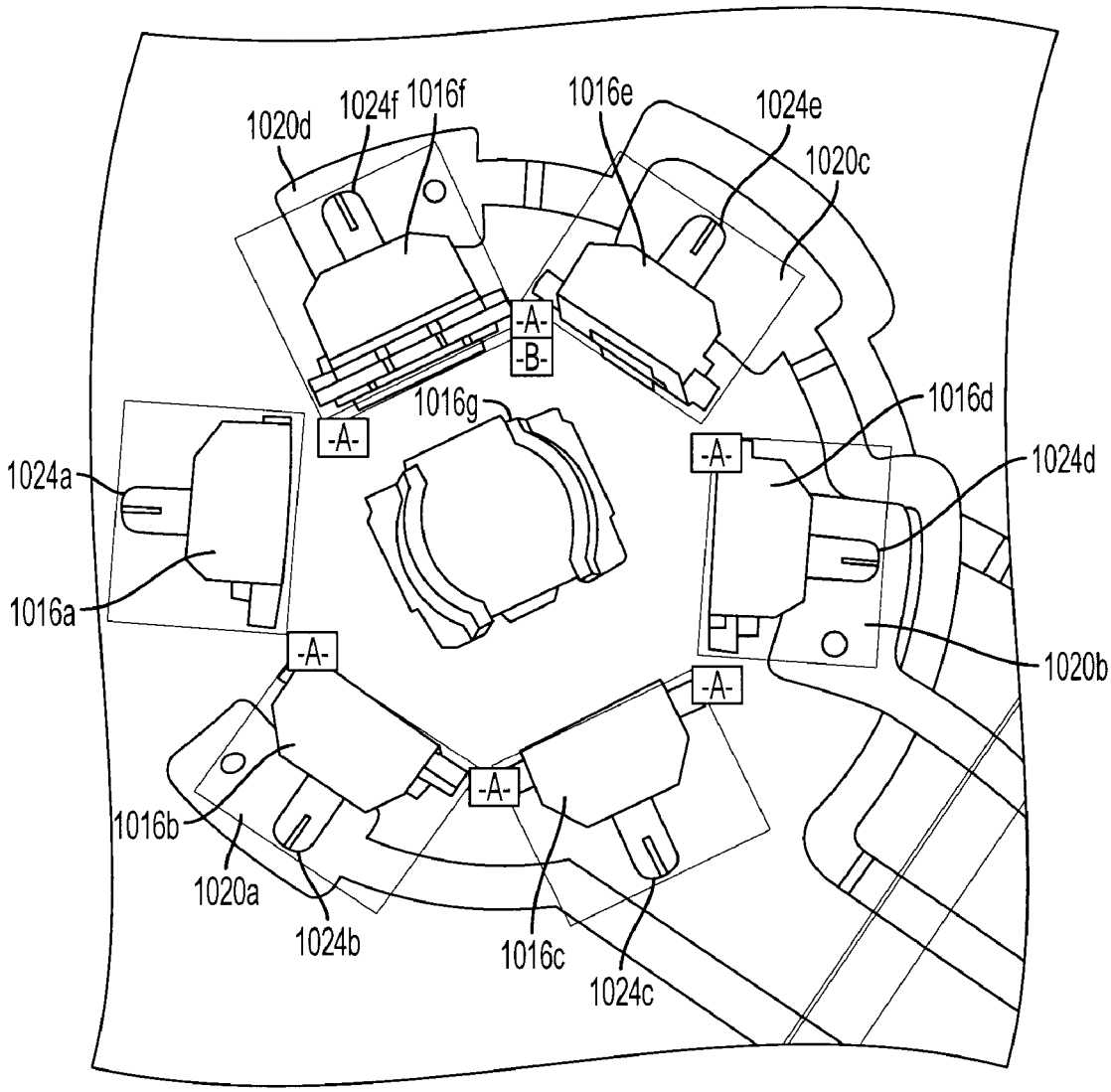
FIG. 41 is a plan view of a terminal and wiring bus arrangement of a combination connector consistent with the present invention.

With specific reference to FIGS. 39 and 40, each of the four-way connector portion 1002 and the seven-way connector portion 1004 may include one or more terminals 1014*a-d* and 1016*a-g* respectively. According to an aspect of the present invention, the connector 1000 may include a wiring bus provided by electrically coupling at least one terminal 1014*a-d* of the first connector portion 1002 with at least one terminal 1016*a-g* of the second connector portion 1004. As shown, the wiring bus may include extensions 1018*a-d* of the terminals 1014*a-d*, which may electrically couple the terminals 1014*a-d* of the first connector portion 1002 with the terminals of the second connector portion 1016*a-g*. In one such embodiment, the wiring bus may be provided as a multi-level arrangement, as shown, and as described in connection with FIGS. 14*a*-14*e*.

In an embodiment consistent with the present invention, the terminals 1014*a-d* of the first connector portion 1002 may be inserted molded with the body portion 1001 of the connector 1000. As shown in FIG. 38, as molded the body portion 1001 may leave contact pads 1020*a-d* of the terminal extensions 1018*a-d* exposed in the region of the second connector portion 1004, as viewed from the top of the connector 1000. The terminals 1016*a-g* of the second connector portion 1004 may be at least partially received in the body portion 1001 and one or more the terminals 10016*a-g* may be electrically coupled to at least one of the contact pads 1020*a-d*.

Figure 42:
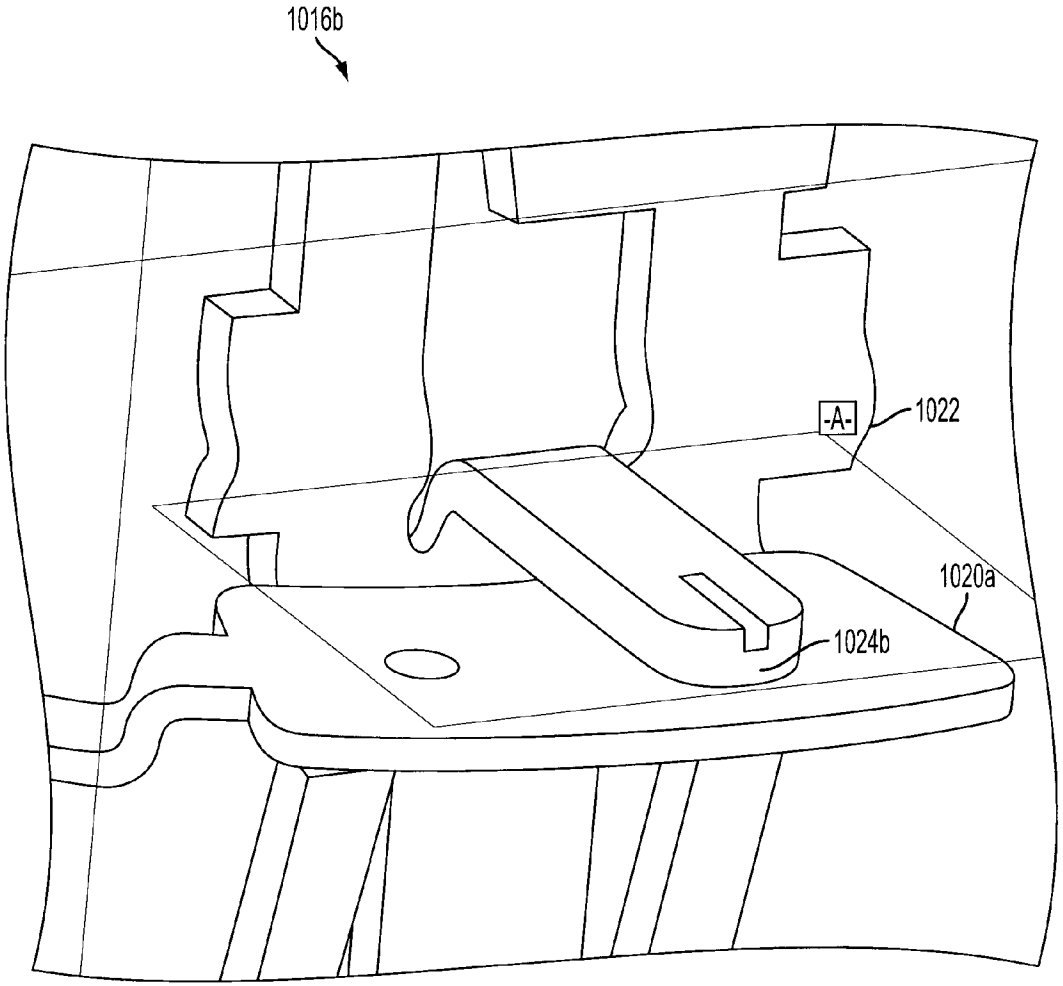
FIG. 42 is a detailed view depicting a terminal of a first connector portion coupled to a terminal of a second connector portion consistent with the present invention.

In one embodiment, the terminals 1016*a-g* of the second connector portion 1004 may be of a "push to seat" variety. In such an embodiment, the terminals 1016*a-g* may be received in openings, e.g., 1021, in the connector body portion. As shown in FIG. 42, a terminal 1016*b* may include one or more arcuate protruding regions, or undulations, 1022. In one such embodiment, the terminal 1016*b* may be received in the opening 1021 in the connector body portion 1001 that is narrower than the outward protrusion of the arcuate protruding region 1022. The arcuate protruding region 1022 may engage the opening 1021 and/or may provide a snug fit between the terminal 1016*b* and the connector body portion 1001. Insertion of the terminal 1016*b* into the opening 1021 in the body portion 1001 may cause the arcuate protruding region 1022 to resiliently deform and bear against the opening 1021 in the body portion 1001, thereby at least partially securing the terminal 1016*b* in the body portion 1001.

According to another aspect, one or more terminals 1016*a-g* of the second connector portion 1004 may include a contact flange 1024*a-f*. When the terminals 1016*a-g* are assembled to the connector body portion, one or more of the terminals 1016*a-g* may be pressed into the body portion 1001 until the contact flange 1024*a-f* contacts a contact pad 1020*a-d*. Contact between a contact flange 1024*a-f* of a terminal 1016*a-g* and a contact pad 1020*a-d* may electrically couple at least one terminal 1016*a-g* of the second connector portion 1004 with at least one terminal 1014*a-d* of the first connector portion 1002. In one embodiment, the connection between a contact flange 1024*a-f* and a contact pad 1020*a-d* may be enhanced and/or secured by mechanically coupling a contact flange 1024*a-f* and a contact pad 1020*a-d*, e.g., by resistance welding, soldering, adhesive bonding, etc.

Figure 43:
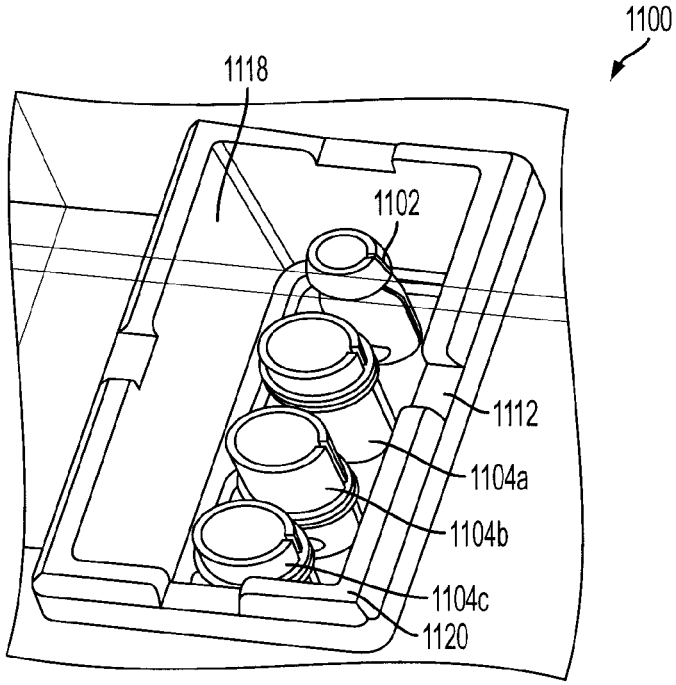
FIG. 43 is a top perspective view of a first connector portion of a combination connector consistent with the present invention.
Figure 44:
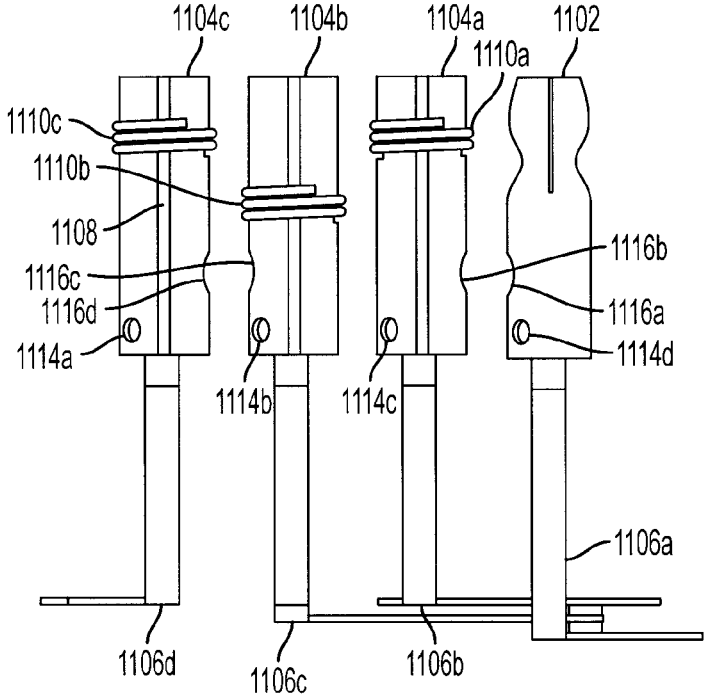
FIG. 44 is a side view of an embodiment of a terminal array which may be used in connection with the first connector portion of FIG. 43.
Figure 45:
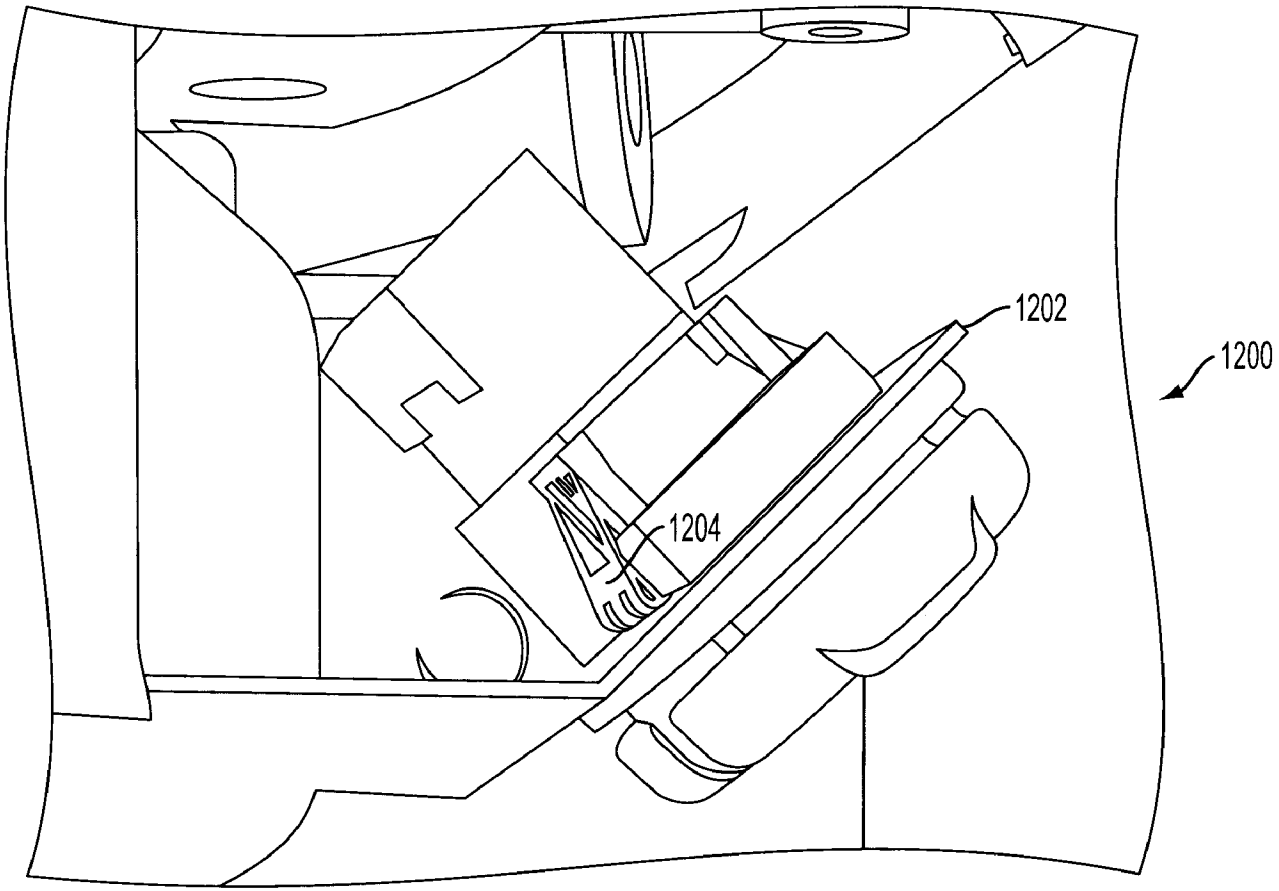
FIG. 45 depicts and embodiment of a connector attached to a mounting bracket consistent with the present invention.

Turning to FIGS. 43 and 44, an embodiment of a connector terminal arrangement 1100 of a portion of a connector consistent with the present invention is shown. As illustrated, the terminal arrangement 1100 may include one, or more, plug-type terminals 1102, and one or more receptacle-type terminals 1104*a-c*. As shown, the terminals 1102, 1104*a-c* may include terminal extensions 1106*a-d*. In one embodiment, the terminal extensions 1106*a-d* may be associated with a connector wiring bus, as disclosed herein, and/or may be coupled to a connector wiring harness, etc.

According to one aspect, a receptacle-type terminal 1104*a-c* may generally be configured as a tubular member including a longitudinal slot or separation 1108 extending along at least a portion of the length of the terminal 1104*c*. The slot or separation 1108 may allow the receptacle-type terminal 1104*c* to expand, e.g., during insertion of a cooperating plug-type terminal. One or more of the terminals 1104*a-c* may include a resilient feature urge the terminals 1104*a-c* toward a contracted condition. Accordingly, a terminal 1104*a-c* may expand upon insertion of a cooperating plug, and/or may be urged to contract when the plug is extracted. Additionally, a terminal 1104*a-c* may be urged in to contact with a plug inserted therein. The foregoing configuration may allow the terminals to maintain their shape, for example, after repeated insertions and extractions of a plug, etc., and may assist in achieving electrical coupling between the terminal and a cooperating plug.

As shown, the resilient feature may be a spring 1110*a-c*, such as a coil spring, which may be disposed around the terminal. As discussed, the spring 1110*a-c* may urge the terminal 1104*a-c* toward a contracted condition, and may permit resilient expansion of the receptacle terminal 1104*a-c*. As shown, the springs 1110*a-c* of adjacent terminals 1104*a-c* may be offset, or staggered, relative to one another along the lengths of the terminals. According to one aspect, the offset arrangement may, in some embodiments, reduce the occurrence and/or likelihood of contact and/or shorting between adjacent terminals 1104*a-c*.

In an embodiment, one or more of the terminals 1102, 1104*a-c* may be inserted molded into a connector body portion 1112. One or more of the terminals 1102, 1104*a-c* may include a hole 1114*a-d* that may allow a plastic resin forming at least a portion of the connector body portion 1112 to flow through the hole 1114*a-d* and into at least a portion of an interior of the terminal 1102, 1104*a-c*. The plastic resin extending through the hole 1114*a-d* may, at least in part, anchor the terminals 1102, 1104*a-c* to the connector body portion 1112. In such an embodiment, the terminals 1102, 1104*a-c* may resist separation from the connector body portion 1112.

As shown in FIG. 43, in one embodiment the terminals 1102, 1104*a-c* may be at least partially surrounded by a wall 1118. The wall 1118 may be an upstanding wall extending from a surface of the connector body portion 1112 and/or may be a wall defining a depression or recess in the connector body portion 1112. According to one aspect, an elastomeric material 1120 may be disposed at least partially surrounding the terminals 1102, 1104*a-c*. A cooperating connector may seal against the elastomeric material 1120 when the cooperating connector is coupled to the connector terminal arrangement 1100. Any suitable elastomeric material, such as silicone, may be employed consistent with this aspect of the disclosure.

Consistent with the use of an elastomeric material for sealing against a cooperating connector, one or more of the terminals 1102, 1104*a-c* may include an elastomeric material at least partially inside of the terminal 1102, 1104*a-c* to seal the inside of the terminal 1102, 1104*a-c*. One or more of the terminals 1102, 1104*a-c* may include a potting flow-though hole 1116*a-d*. The potting flow-through holes 1116*a-d* may allow at least a portion of a flowable elastomeric resin or material introduced outside of the terminals 1102, 1104*a-c* to flow to the inside of the terminals 1102, 1104*a-c*. The elastomeric resin may be introduced in a flowable and/or liquid form, for example by injection molding or as a liquid potting composition.

Referring next to FIGS. 45 through 49, an embodiment of a mounting arrangement for a connector 1200 is illustrated. As shown, the connector 1200 may be mounted, for example, to a mounting bracket 1202 on a vehicle, etc. The connector 1200 may include one or more locking clips 1204 for securing the connector 1200 to the mounting bracket. According to one aspect, the locking clips 1204 may permit press-in attachment of the connector 1200 to the mounting bracket.

Figure 46:
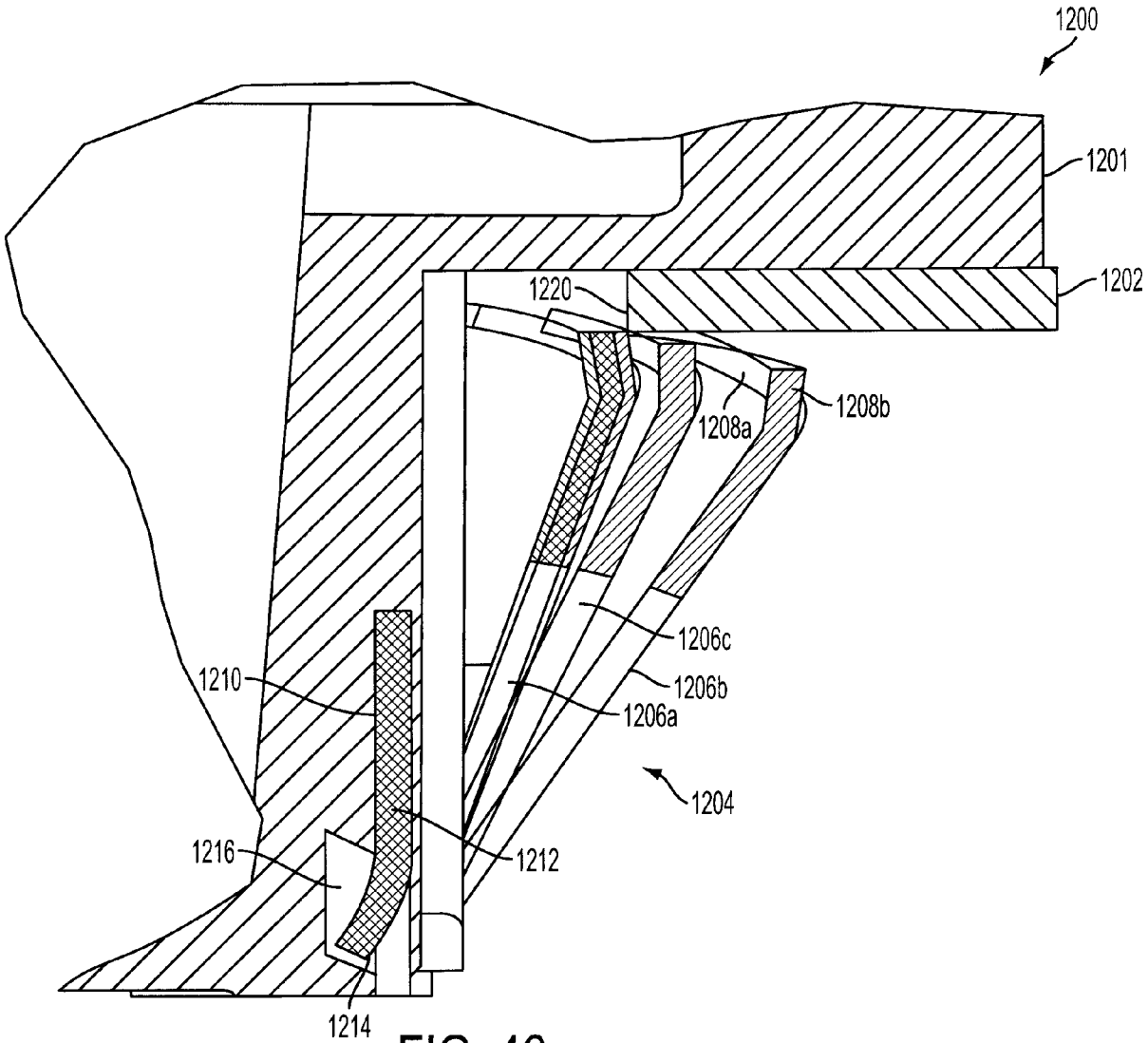
FIG. 46 is a schematic cross-sectional view showing a mounting arrangement of a connector using a locking clip consistent with the present invention.
Figure 47:
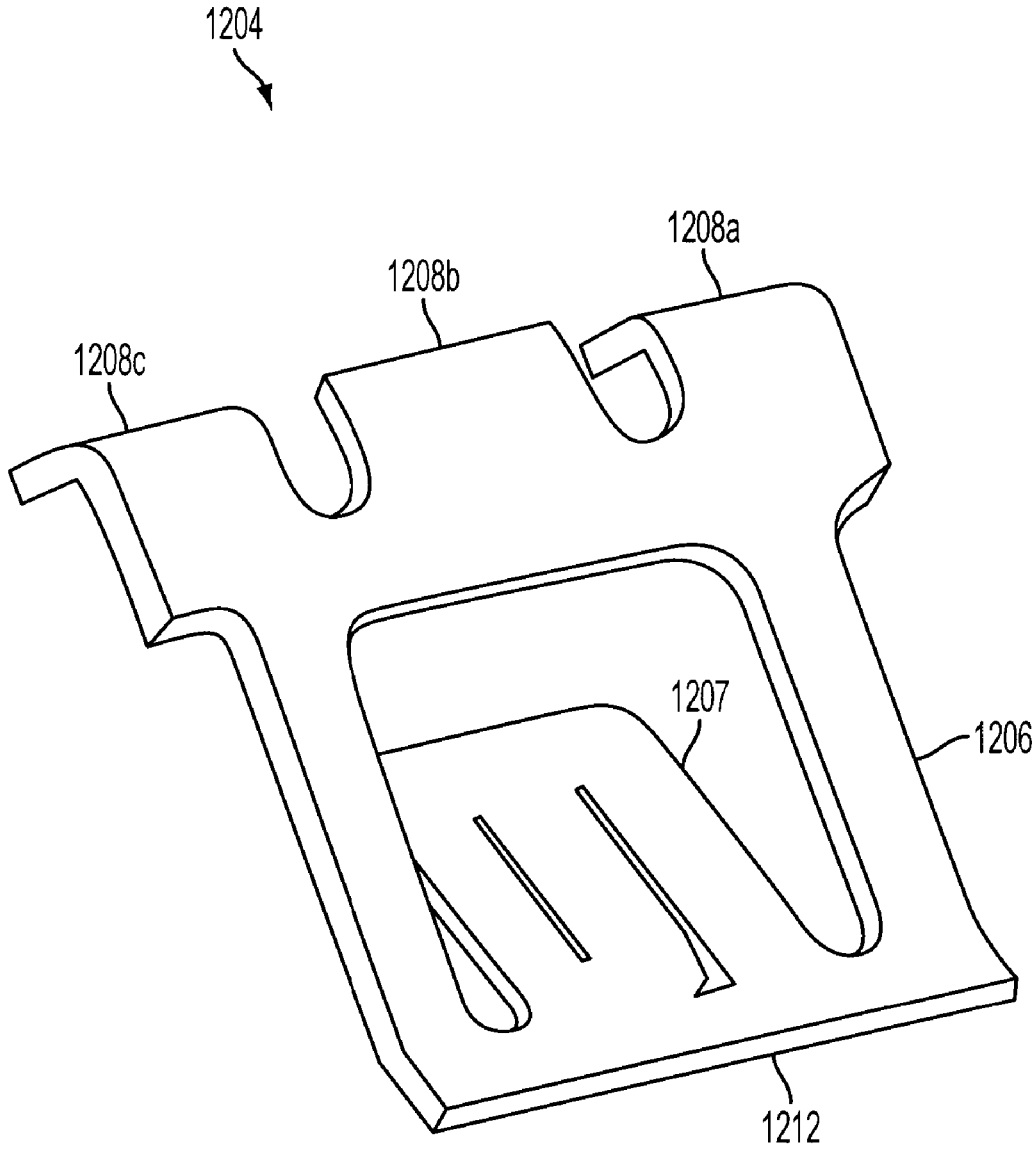
FIG. 47 is a perspective view of a locking clip consistent with the present invention.
Figure 48:
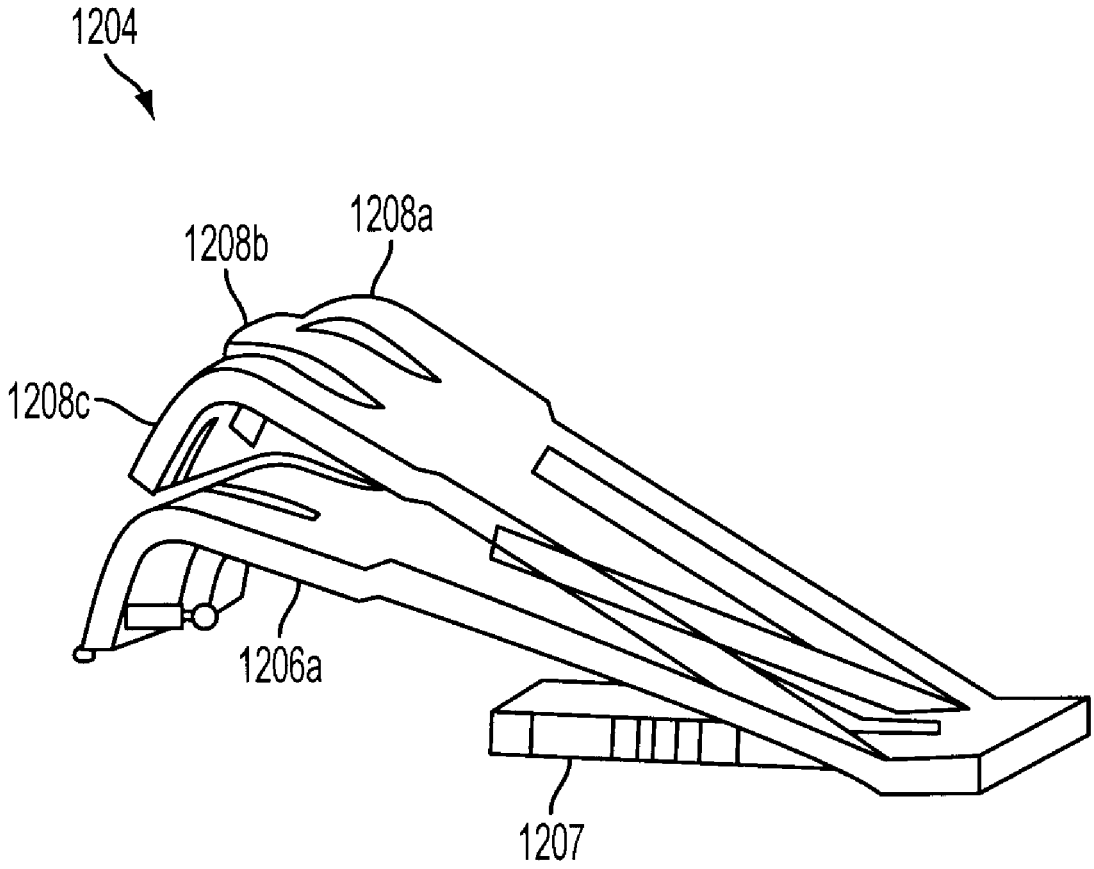
FIG. 48 is a side perspective view of a locking clip consistent with the present invention showing a resilient member in an inwardly deflected position and an outwardly deflected position.

As shown in FIGS. 46 through 48, the locking clip 1204 may be configured having a resilient member 1206 and an attachment portion 1207. As shown in FIGS. 46 and 48, the resilient member 1206 may be resiliently deflectable toward the attachment portion 1207, as indicated by 1206A, and may be have an un-deflected position angled away from the attachment member 1207, as indicated by 1206B. The resilient member may also be resiliently deflectable to various intermediate positions, such as 1206C shown in FIG. 46. The resilient member 1206 may include a plurality of finger portions 1208*a-c* adjacent an end of the resilient member 1206. As best shown in FIG. 48, an end of at least one of the fingers 1208*a*, 1208*c* may be bent, curved, etc., generally toward the plane of the attachment portion 1207. At least another of the fingers 1208*b* may be straight and/or may be curved, bent etc. toward the plane of the attachment portion 1207 to a lesser degree, and/or may be shorter than at least one of the other fingers 1208*a*, 1208*c*. According to an embodiment, the locking clip 1204 may be formed as a stamped sheet of a resilient material, such as spring steel, sheet metal, etc. Various other techniques may also be employed to form the locking clip 1204.

The locking clip 1204 may be attached to connector 1200 by inserting the attachment portion 1207 into a recess, or slot 1210, formed in the connector body 1201. According to one embodiment, the locking clip 1204 may be secured to the connector 1200 by a resilient tab 1212 of the attachment portion 1207. An end 1214 of the tab 1212 may be displaced outwardly from the attachment portion 1207. The end 1214 may be resiliently deflected toward the attachment portion 1207 while the attachment portion 1207 is being inserted into the slot 1210 of the connector body 1201. When the attachment portion 1207 is inserted into the slot 1210, the end 1214 of the tab 1212 may at least partially resiliently recover to an outwardly displaced configuration extending at least partially into a recess 1216 formed in the connector body 1201. Interaction between the tab 1212 and the recess 1216 may resist removal of the locking clip 1204 from the connector 1200.

With particular reference to FIG. 46, with the locking clip 1204 attached to the connector, the connector 1200 may be mounted to a vehicle, e.g., via a mounting bracket 1202 by pressing the connector 1200 though an opening 1220 in the bracket 1202. As the connector 1200 is pressed into the opening 1220 in the mounting bracket 1202, the resilient member 1206 may bear against the opening 1220 and resiliently deflect inwardly toward the connector 1200, for example, as shown by 1206A. As the fingers 1208*a-c* pass through the opening 1220, the resilient member 1206 and/or the fingers 1208*a-c*, may resiliently recover outwardly from the connector 1200. The degree of outward resilient recovery may, at least in part be a function of the depth of penetration of the resilient member 1206 relative to the mounting bracket 1202.

At an intermediate level of recovery of the resilient member, indicated by 1206C, the shorter and/or less curved or bent finger 1208*b* may extend at least partially outside of the opening 1220. An extracting force applied to the connector 1220 may cause the finger 1208*b* to bear against the mounting bracket 1202, and thereby resist extraction of the connector 1200 from the opening 1220 of the bracket 1202. One or more of the other fingers 1208*a*, 1208*c* may bear against the margin of the opening 1220. The fingers 1208*a*, 1208*c* bearing against the margin of the opening 1220 may urge the connector 1200 further into the opening 1220, which may assist in securely maintaining the connector 1200 attached to the mounting bracket.

At a greater level of recovery of the resilient member, indicated by 1206B in FIG. 46, which may be associated with a greater depth of penetration, all of the fingers 1208*a-c* may be at least partially beyond the margin of the opening 1220 of the mounting bracket 1202. The longer and/or more bent fingers 1208*a*, 1208*c* may bear against the mounting bracket 1202, which may assist in securely retaining the connector in the opening 1220 of the mounting bracket 1202. An extracting force applied to the connector 1200 may cause one or more of the fingers 1208*a-c* to bear against the mounting bracket 1202 and resist extraction of the connector 1200 from the opening 1220.

Figure 49:
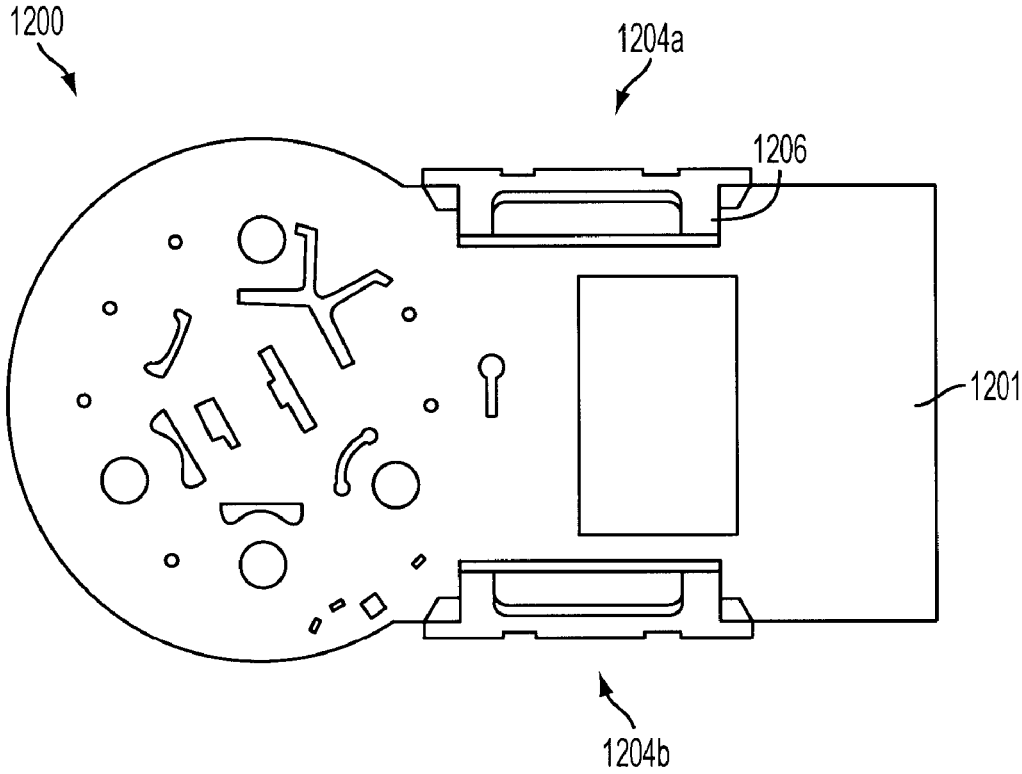
FIG. 49 is a bottom view of a connector including two locking clips consistent with the present invention.

A bottom view of the connector 1200 is shown in FIG. 49. As depicted, the connector 1200 may include two locking clips 1204A, 1204B. The resilient member 1206 may extend outwardly from the connector body 1201, as described above. In the illustrated configuration, when the connector 1200 is installed in a mounting opening, such as in a mounting bracket, the connector 1200 may be secured on two opposed sides of the connector body 1201, corresponding to the two locking clips 1204A, 1204B. The locking clips 1204A, 1204B may permit a low installation force for facile mounting of the connector 1200. Additionally, the locking clips 1204A, 1204B may provide a relatively high extraction force, providing secure mounting of the connector 1200.

Consistent with the forgoing, according to one aspect of the present invention there may be provided an electrical connector including a first connector portion including a plurality of first connector terminals, and a second connector portion separate from the first connector portion and including a plurality of second connector terminals. Each of the first connector terminals may be coupled to an associated one of the second connector terminals at a different associated distance from a top of one of the second connector terminals.

According to another aspect of the present invention, there may be provided an electrical connector including a body having a first connector portion and second connector portion. The connector may also include a first cover pivotally coupled to the body adjacent the first connector portion and a second cover pivotally coupled to the body adjacent to the second connector portion. A biasing element may be provided biasing the first cover toward a closed position relative to the first connector portion and biasing the second cover toward a closed position relative to the second connector portion.

According to yet another aspect of the present invention there may be provided a connector having a terminal including a tubular member having a slot extending axially along at least a portion of the member. A resiliently expandable member may be disposed around the tubular member adjacent to an end of the tubular member.

According to still a further aspect of the present invention, a method is provided for forming a connector. The method may include providing at least one first connector terminal having a terminal extension including a contact pad. A connector body may be insert molded around the at least one first connector terminal and the connector body may be formed having an opening exposing at least a portion of the contact pad of the terminal extension. At least a portion of a second connector terminal may be inserted into the opening. The method may further include electrically coupling the second connector terminal to the contact pad.

It should also be understood that the various features and aspects of the exemplary connectors described herein may be combined with one another. Furthermore, the features and aspects of the invention herein are susceptible to use with other electrical connectors in addition to the exemplary seven-way and four-way electrical connection between a vehicle and a towed apparatus.

The embodiments that have been described herein are but some of the several which utilize this invention and are set forth here by way of illustration, but not of limitation. It is obvious that many other embodiments, which will be readily apparent to those skilled in the art may be made without departing materially from the spirit and scope of the invention.

What is claimed is:

1. An electrical connector comprising:

a body including a first connector portion comprising a plurality of first connector terminals and a second connector portion comprising a plurality of second connector terminals;

a first cover pivotally coupled to said body adjacent said first connector portion by a hinge pin;

a second cover pivotally coupled to said body adjacent said second connector portion by said hinge pin, said hinge pin being disposed between said first connector portion and said second connector portion and extending through at least a portion of said body, said first cover and said second cover to provide a common hinge point for said first and second covers; and a biasing element biasing said first cover toward a closed position relative to said first connector portion and biasing said second cover toward a closed position relative to said second connector portion, wherein when one of said first and second covers is in an open position, pivotal movement of the other of said first and second covers is restricted.

2. An electrical connector according to claim 1, wherein said biasing element comprises a spring applying a biasing force to said first cover and to said second cover.

3. An electrical connector according to claim 1, wherein opening one of said first cover and said second cover prevents opening the other of said first cover and said second cover.

4. An electrical connector according to claim 1, said connector comprising a first number of said first connector terminals and a second number of said second connector terminals, said second number being greater than said first number.

5. An electrical connector according to claim 1, wherein said first connector portion comprises a four-way connector comprising four of said first connector terminals and said second connector portion comprises a seven-way connector comprising seven of said second connector terminals.

6. A connector according to claim 1, wherein said spring includes an extending loop engaging and biasing one of said first and second covers and first and second extending ends engaging and biasing the other of said first and second covers.

7. An electrical connector comprising:

a body including a first connector portion comprising a plurality of first connector terminals and a second connector portion comprising a plurality of second connector terminals;

a first cover pivotally coupled to said body adjacent said first connector portion;

a second cover pivotally coupled to said body adjacent said second connector portion; and a biasing element biasing said first cover toward a closed position relative to said first connector portion and biasing said second cover toward a closed position relative to said second connector portion, wherein at least one of said first connector terminals or said second connector terminals comprises a tubular member comprising a slot extending axially along at least a portion of said tubular member; and wherein said connector further comprises a resiliently expandable member disposed around said tubular member.

8. A connector according to claim 7, wherein said resiliently expandable member comprises a coil spring disposed around said tubular member.

9. A connector according to claim 7, wherein said resiliently expandable member biases said terminal to a contracted condition.

10. A connector according to claim 7, wherein adjacent ones of said first connector terminals or said second connector terminals comprises an associated one of said tubular members, and wherein said connector comprises a plurality of said resiliently expandable members, each of said resiliently expandable members being disposed around an associated one of said tubular members and being offset along the length of said associated one of said tubular members relative to one another.

11. An electrical connector comprising:

a body including a four-way connector portion comprising a four first connector terminals and a seven-way connector portion comprising a seven second connector terminals;

a first cover pivotally coupled to said body through a pin disposed between said four-way and said seven-way connector portions;

a second cover pivotally coupled to said body through said pin; and a biasing element biasing said first cover toward a closed position relative to said four- way connector portion and biasing said second cover toward a closed position relative to said seven-way connector portion, whereby when one of said first and second covers is in an open position, pivotal movement of the other of said first and second cover is restricted, wherein at least one of said first connector terminals or said second connector terminals comprises a tubular member comprising a slot extending axially along at least a portion of said tubular member; and wherein said connector further comprises a resiliently expandable member disposed around said tubular member.

12. A connector according to claim 11, wherein said resiliently expandable member comprises a coil spring disposed around said tubular member.

13. A connector according to claim 11, wherein said resiliently expandable member biases said terminal to a contracted condition.

14. A connector according to claim 11, wherein adjacent ones of said first connector terminals or said second connector terminals comprises an associated one of said tubular members, and wherein said connector comprises a plurality of said resiliently expandable members, each of said resiliently expandable members being disposed around an associated one of said tubular members and being offset along the length of said associated one of said tubular members relative to one another.

* * * * *